US007234521B2

(12) United States Patent
Shammai et al.

(10) Patent No.: US 7,234,521 B2
(45) Date of Patent: Jun. 26, 2007

(54) METHOD AND APPARATUS FOR PUMPING QUALITY CONTROL THROUGH FORMATION RATE ANALYSIS TECHNIQUES

(75) Inventors: Michael Shammai, Houston, TX (US); Jaedong Lee, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 357 days.

(21) Appl. No.: 10/797,815

(22) Filed: Mar. 10, 2004

(65) Prior Publication Data

US 2004/0231842 A1 Nov. 25, 2004

Related U.S. Application Data

(63) Continuation-in-part of application No. 09/910,209, filed on Jul. 20, 2001, now Pat. No. 6,609,568.

(60) Provisional application No. 60/464,917, filed on Apr. 23, 2003, provisional application No. 60/453,316, filed on Mar. 10, 2003.

(51) Int. Cl.
*E21B 49/10* (2006.01)

(52) U.S. Cl. ..... 166/264; 166/66; 73/152.23

(58) Field of Classification Search ..... 166/264, 166/66, 250.02, 250.07, 250.17, 100; 73/152.18, 73/152.23, 152.24
See application file for complete search history.

(56) References Cited

U.S. PATENT DOCUMENTS

| | | | | |
|---|---|---|---|---|
| 2,514,690 | A | 7/1950 | Bliss et al. | |
| 3,321,965 | A | 5/1967 | Johnson et al. | |
| 4,513,612 | A * | 4/1985 | Shalek | 73/152.24 |
| 4,742,459 | A * | 5/1988 | Lasseter | 702/12 |
| 5,233,866 | A | 8/1993 | Desbrandes | |
| 5,269,180 | A * | 12/1993 | Dave et al. | 73/152.06 |
| 5,303,775 | A | 4/1994 | Michaels et al. | |
| 5,473,939 | A * | 12/1995 | Leder et al. | 73/152.12 |
| 5,587,525 | A * | 12/1996 | Shwe et al. | 73/152.52 |
| 5,703,286 | A | 12/1997 | Proett et al. | |
| 5,708,204 | A | 1/1998 | Kasap | |
| 5,803,186 | A | 9/1998 | Berger et al. | |
| 6,568,487 | B2 * | 5/2003 | Meister et al. | 175/50 |
| 6,609,568 | B2 | 8/2003 | Krueger et al. | |
| 2004/0020649 | A1 | 2/2004 | Fields | |
| 2004/0231408 | A1 * | 11/2004 | Shammai | 73/152.27 |

FOREIGN PATENT DOCUMENTS

| | | |
|---|---|---|
| EP | 0 490 421 A1 | 6/1992 |
| EP | 0 520 903 A2 | 12/1992 |
| EP | 0 698 722 A2 | 2/1996 |

(Continued)

*Primary Examiner*—Kenneth Thompson
(74) *Attorney, Agent, or Firm*—Madan, Mossman & Sriram, P.C.

(57) ABSTRACT

The present invention provides a method and apparatus for determination of the quality of a formation fluid sample including monitoring permeability and mobililty versus time to determine a filtrate contamination level, single phase state without gas and solids in the formation fluid, as it existed in the formation and the determination of laminar flow from the formation. The present invention also enables determination of an optimal pumping rate to match the ability of a subsurface formation to produce a single phase formation fluid sample in minimum time. The method and apparatus also detect pumping problems such as sanding and loss of seal with borehole.

28 Claims, 16 Drawing Sheets

FOREIGN PATENT DOCUMENTS

| | | | |
|---|---|---|---|
| WO | WO 01/98630 | A1 | 12/2001 |
| WO | WO 02/08570 | A1 | 1/2002 |
| WO | WO 02/08571 | A1 | 1/2002 |
| WO | WO 03/104602 | A2 | 12/2003 |
| WO | WO 2004/025079 | A2 | 3/2004 |

* cited by examiner 1410 1412 1414 1416

| | Summary of Examples | | | |
|---|---|---|---|---|
| | P* (psi) | Mobility (md/cp) | Ct (1/psi) | Correlation Coef. |
| 1402 First Stroke | 4607.3 | 321.8 | 2.76E-5 | 0.99 |
| 1404 Second Stroke | 4606.4 | 335.7 | 1.73E-5 | 0.99 |
| 1406 Third Stroke | 4606.7 | 347.6 | 1.5E-5 | 0.99 |
| 1408 Three Combined | 4606.9 | 334.1 | 2.0E-5 | 0.99 |

History plot of pumping data used. Three strokes of BB pump.

FRA plot for the three strokes combined.

Pumping history for example 2

METHOD AND APPARATUS FOR PUMPING QUALITY CONTROL THROUGH FORMATION RATE ANALYSIS TECHNIQUES

CROSS REFERENCE TO RELATED APPLICATIONS

This patent application claims priority from U.S. Provisional Patent Application Ser. No. 60/453,316 filed on Mar. 10, 2003 and from US. Provisional Patent Application Ser. No. 60/464,917 filed on Apr. 23, 2003. This patent application is a continuation in part of U.S. application Ser. No. 09/910,209, entitled Closed-Loop Draw down Apparatus and Method for In-Situ Analysis of Formation Fluids, by V. Krueger et al. filed on Jul. 20, 2001, now U.S. Pat. No. 6,609,568 issue on Aug. 26, 2003 published on Aug. 22, 2002 which is incorporated herein by reference in its entirety, which along with the current application is commonly owned by Baker Hughes, Incorporated.

BACKGROUND OF THE INVENTION

1. Field of the Invention

The present invention relates generally to the field of quality control for formation fluid sampling and in particular to the determination of permeability and mobility versus time to provide an indication as to whether a formation sample is in a single phase state, experiencing laminar flow and low filtrate contamination, to ensure acquisition of a single phase sample of optimal purity and in the same condition as it existed in the formation by applying formation rate analysis during pumping of a sample from a formation. The method and apparatus also provide for detection of pumping problems (correlation coefficient for pressure versus formation flow rate) and to the matching of an optimal pumping rate to the ability of the formation to produce (mobility, compressibility).

2. Summary of the Related Art

To obtain hydrocarbons such as oil and gas, boreholes are drilled by rotating a drill bit attached at a drill string end. A large proportion of the current drilling activity involves directional drilling, i.e., drilling deviated and horizontal boreholes to increase the hydrocarbon production and/or to withdraw additional hydrocarbons from the earth's formations. Modern directional drilling systems generally employ a drill string having a bottom hole assembly (BHA) and a drill bit at an end thereof that is rotated by a drill motor (mud motor) and/or by rotating the drill string. A number of down hole devices placed in close proximity to the drill bit measure certain down hole operating parameters associated with the drill string. Such devices typically include sensors for measuring down hole temperature and pressure, azimuth and inclination measuring devices and a resistivity-measuring device to determine the presence of hydrocarbons and water. Additional down-hole instruments, known as logging-while-drilling (LWD) tools, are frequently attached to the drill string to determine the formation geology and formation fluid conditions during the drilling operations.

Commercial development of hydrocarbon fields requires significant amounts of capital. Before field development begins, operators desire to have as much data as possible in order to evaluate the reservoir for commercial viability. Despite the advances in data acquisition during drilling using the MWD systems, it is often necessary to conduct further testing of the hydrocarbon reservoirs in order to obtain additional data. Therefore, after the well has been drilled, the hydrocarbon zones are often tested with other test equipment.

One type of post-drilling test involves producing fluid from the reservoir, shutting-in the well, collecting samples with a probe or dual packers, reducing pressure in a test volume and allowing the pressure to build-up to a static level. This sequence may be repeated several times at several different depths or point within a single reservoir and/or at several different reservoirs within a given borehole. One of the important aspects of the data collected during such a test is the pressure build-up information gathered after drawing the pressure down. From these data, information can be derived as to permeability, and size of the reservoir. Further, actual samples of the reservoir fluid must be obtained, and these samples must be tested to gather Pressure-Volume-Temperature and fluid properties such as density, viscosity and composition.

In order to perform these important tests, some systems require retrieval of the drill string from the borehole. Thereafter, a different tool, designed for the testing, is run into the borehole. A wireline is often used to lower the test tool into the borehole. The test tool sometimes utilizes packers for isolating the reservoir. Numerous communication devices have been designed which provide for manipulation of the test assembly, or alternatively, provide for data transmission from the test assembly. Some of those designs include mud-pulse telemetry to or from a down hole microprocessor located within, or associated with the test assembly. Alternatively, a wire line can be lowered from the surface, into a landing receptacle located within a test assembly, establishing electrical signal communication between the surface and the test assembly. Regardless of the type of test equipment currently used, and regardless of the type of communication system used, the amount of time and money required for retrieving the drill string and running a second test rig into the hole is significant. Further, if the hole is highly deviated, a wire line can not be used to perform the testing, because the test tool may not enter the hole deep enough to reach the desired formation.

An apparatus and method for measuring formation pressure and permeability is described in U.S. Pat. No. 5,233,866 issued to Robert Desbrandes, hereinafter the '866 patent. FIG. 1 is a reproduction of a FIG. from the '866 patent that shows a draw down test method for determining formation pressure and permeability. Referring to FIG. 1, the method includes reducing pressure in a flow line that is in fluid communication with a borehole wall. In Step 2, a piston is used to increase the flow line volume thereby decreasing the flow line pressure. The rate of pressure decrease is such that formation fluid entering the flow line combines with fluid leaving the flow line to create a substantially linear pressure decrease. A "best straight line fit" is used to define a straight-line reference for a predetermined acceptable deviation determination. The acceptable deviation shown is $2\sigma$ from the straight line. Once the straight-line reference is determined, the volume increase is maintained at a steady rate. At a time $t_1$, the pressure exceeds the $2\sigma$ limit and it is assumed that the flow line pressure being below the formation pressure causes the deviation. At $t_1$, the draw down is discontinued and the pressure is allowed to stabilize in Step 3. At $t_2$, another draw down cycle is started which may include using a new straight-line reference. The draw down cycle is repeated until the flow line stabilizes at a pressure twice. Step 5 starts at $t_4$ and shows a final draw down cycle for determining permeability of the formation. Step 5 ends at $t_5$ when the flow line pressure builds up to the borehole pressure Pm. With the flow line pressure equalized to the borehole pressure, the chance of sticking the tool is reduced. The tool can then be moved to a new test location or removed from the borehole.

A drawback of the '866 patent is that the time required for testing is too long due to stabilization time during the "mini-buildup cycles." In the case of a low permeability formation, the stabilization may take from tens of minutes to even days before stabilization occurs. One or more cycles following the first cycle only compound the time problem.

Whether using wire line or MWD, known formation pressure and permeability measurement systems measure pressure by drawing down the pressure of a portion of the borehole to a point below the expected formation pressure in one step to a predetermined point well below the expected formation pressure or continuing the draw down at an established rate until the formation fluid entering the tool stabilizes the tool pressure. Then the pressure is allowed to rise and stabilize by stopping the draw down. The draw down cycle may be repeated to ensure a valid formation pressure is being measured, and in some cases lost or corrupted data require retest. This is a time-consuming measurement process.

U.S. Pat. No. 6,609,568 teaches a formation rate analysis (FRA) apparatus and method that addresses some of the drawbacks described above by utilizing a closed-loop apparatus and method to perform formation pressure and permeability tests more quickly than the devices and methods described above. With quicker formation testing, more tests providing actual pressures and permeability may be provided to enhance well operation efficiency and safety. U.S. Pat. No. 6.609.568 provides an apparatus and method capable of creating a test volume within a borehole, and incrementally decreasing the pressure within the test volume at a variable rate to allow periodic measurements of pressure as the test volume pressure decreases. Adjustments to the rate of decrease are made before the pressure stabilizes thereby eliminating the need for multiple cycles. This incremental draw down apparatus and method will significantly reduce overall measurement time, thereby increasing drilling efficiency and safety.

There is a need for determining fluid mobility while pumping in order to provide quality control and confidence during sampling. There is a need to determine the formation fluid quality and constitution. There is also a need to detect problems during pumping associated with loss of packer seal, sanding and sample fluid going to two-phase.

SUMMARY OF THE INVENTION

The present invention provides a method and apparatus for applying formation rate analysis (FRA) at the end of each pump stroke during sampling operations to provide confidence that a single-phase sample of optimal purity is obtained from the formation. The present invention measures pressure and pump piston position and calculates formation fluid compressibility, mobility and a correlation coefficient indicating that the pumping rate is matched to the formation's ability to produce formation fluid, i.e., formation mobility.

The present invention plots compressibility of formation fluid versus time during pumping to provide a measure of confidence that formation fluid is substantially free of filtrate contamination before capturing a sample. Determination of permeability versus time also provides an indication as to whether a formation sample is in a single phase state and experiencing laminar flow. The compressibility of filtrate is substantially less than the compressibility of formation fluid containing dissolved gas. The present invention also plots pressure versus flow rate to determine a correlation coefficient for detection of pumping problems such as sanding indicative of the collapse of the reservoir due to pumping too fast. The present invention also matches the pumping rate to formation mobility to ensure a single phase sample in the least amount of time. Pumping too fast can cause the formation fluid upstream of the pump to go into two-phase (gas and liquid) and pumping too slow uses excessive pumping time, which can unnecessarily cost thousands of dollars extra.

DESCRIPTION OF THE FIGURES

The novel features of this invention, as well as the invention itself, will be best understood from the attached drawings, taken along with the following description, in which similar reference characters refer to similar parts, and in which.

DESCRIPTION OF THE EXEMPLARY EMBODIMENT

Figure 2:
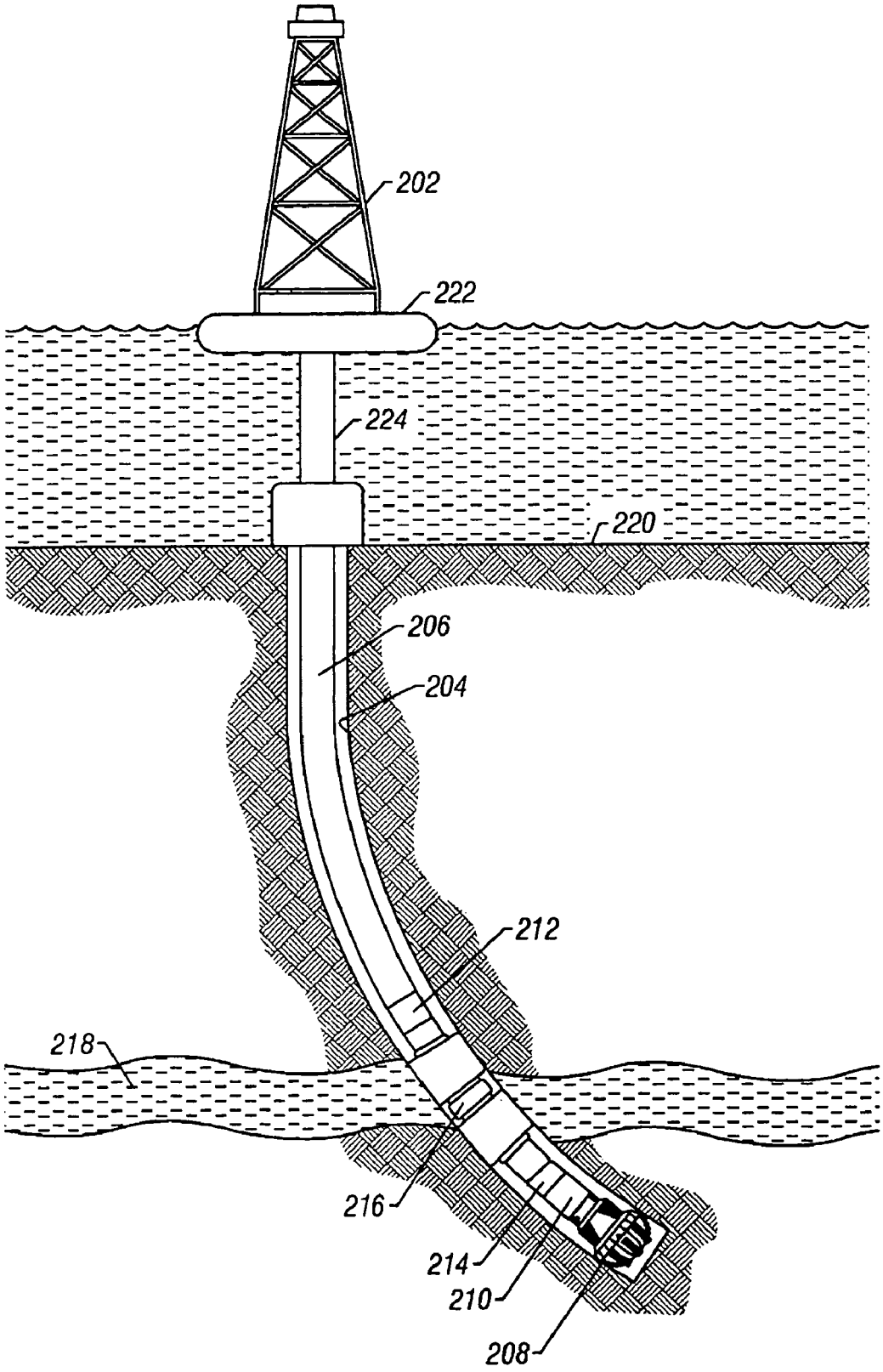
FIG. 2 is an elevation view of an offshore drilling system according to one embodiment of the present invention.
Figure 12:
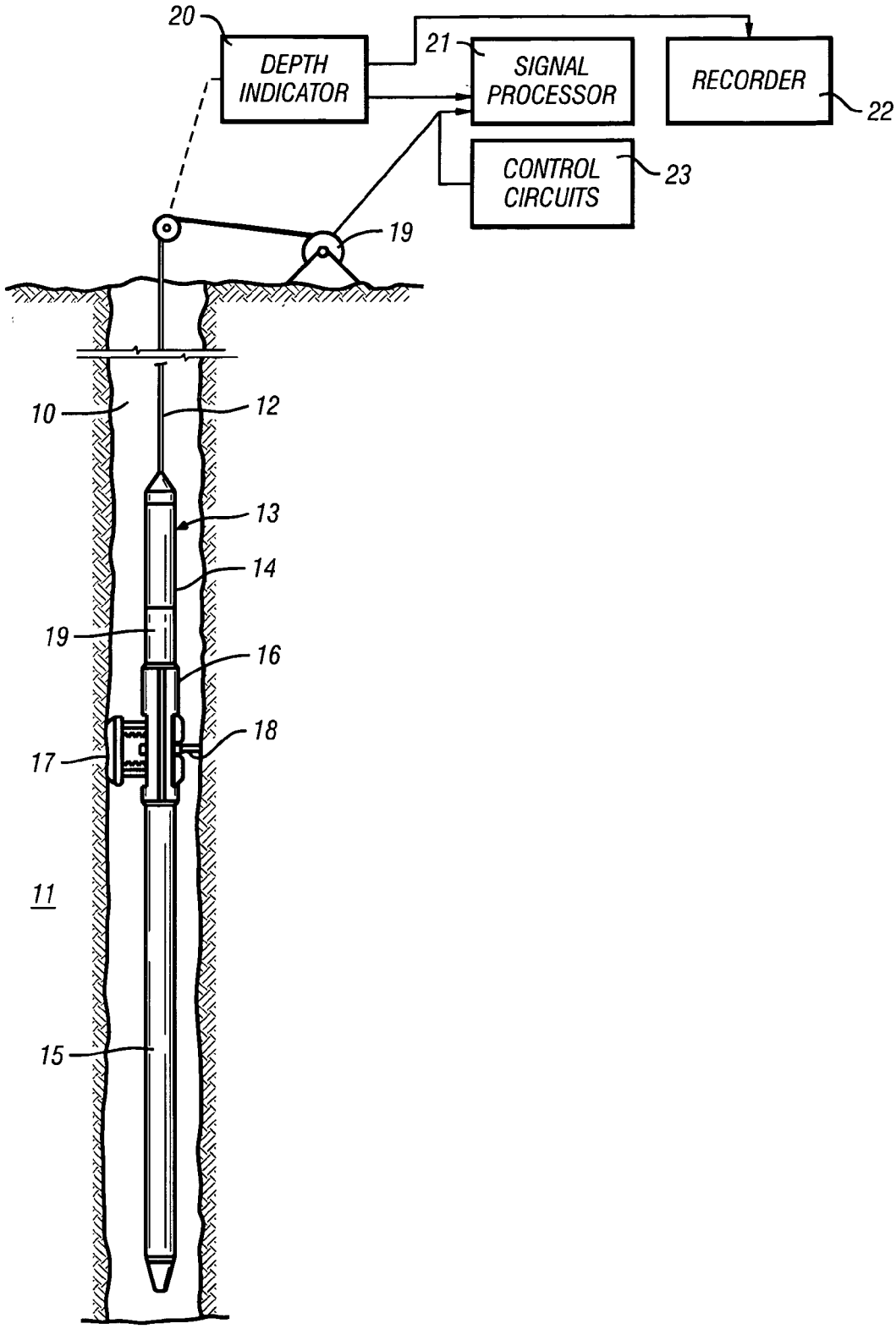
FIG. 12 is an illustration of a wire line formation sampling cool deployed in a well bore.

FIG. 2 is a drilling apparatus according to one embodiment of the present invention. A typical drilling rig 202 with a borehole 204 extending therefrom is illustrated, as is well understood by those of ordinary skill in the art. The drilling rig 202 has a work string 206, which in the embodiment shown is a drill string. The drill string 206 has attached thereto a drill bit 208 for drilling the borehole 204. The present invention is also useful in other types of work strings, and it is useful with a wireline (as shown in FIG. 12), jointed tubing, coiled tubing, or other small diameter work string such as snubbing pipe. The drilling rig 202 is shown positioned on a drilling ship 222 with a riser 224 extending from the drilling ship 222 to the sea floor 220. However, any drilling rig configuration such as a land-based rig may be adapted to implement the present invention.

If applicable, the drill string 206 can have a downhole drill motor 210. Incorporated in the drill string 206 above the drill bit 208 is a typical testing unit, which can have at least one sensor 214 to sense downhole characteristics of the borehole, the bit, and the reservoir, with such sensors being well known in the art. A useful application of the sensor 214 is to determine direction, azimuth and orientation of the drill string 206 using an accelerometer or similar sensor. The BHA also contains the formation test apparatus 216 of the present invention, which will be described in greater detail hereinafter. A telemetry system 212 is located in a suitable location on the work string 206 such as above the test apparatus 216. The telemetry system 212 is used for command and data communication between the surface and the test apparatus 216.

Figure 3:
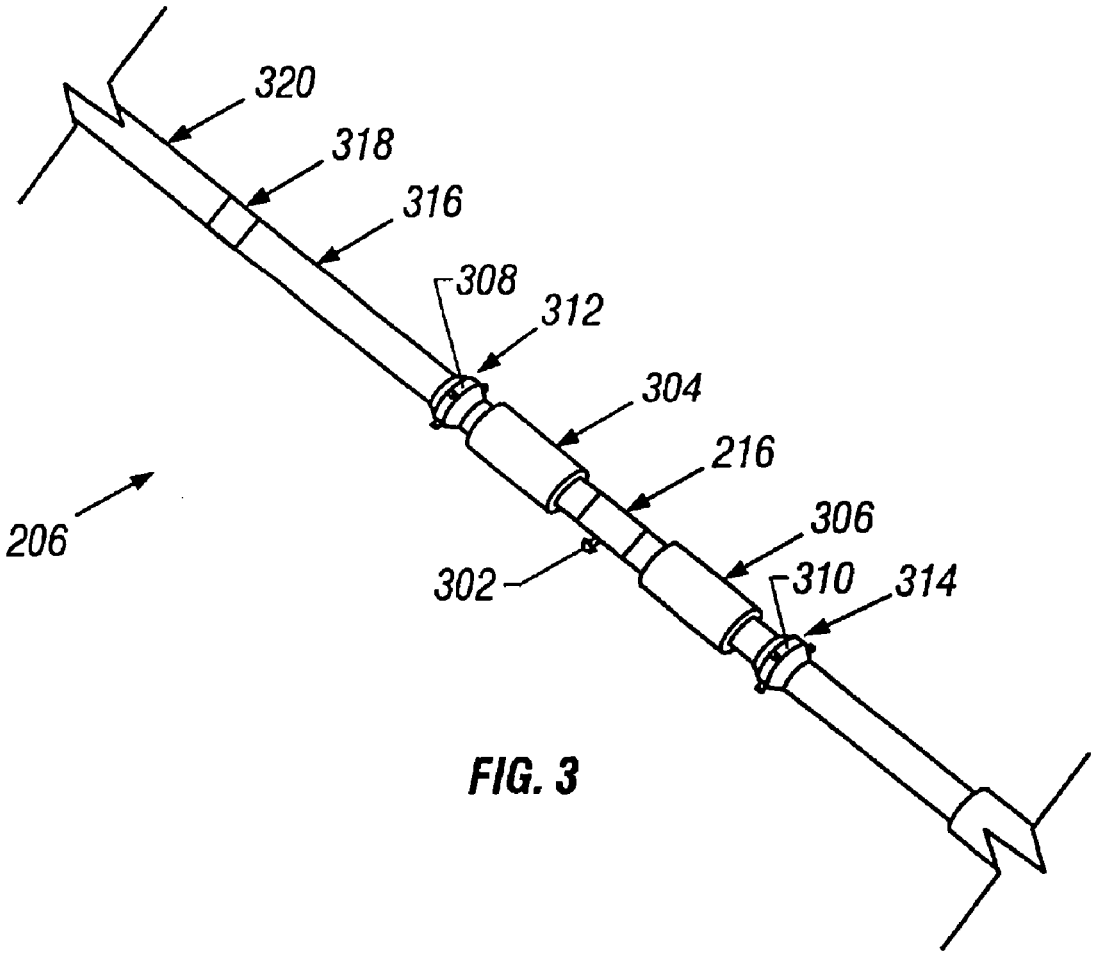
FIG. 3 shows a portion of drill string incorporating the present invention.

FIG. 3 is a section of drill string 206 incorporating the present invention. The tool section is preferably located in a BHA close to the drill bit (not shown). The tool includes a communication unit and power supply 320 for two-way communication to the surface and supplying power to the downhole components. In the exemplary embodiment, the tool requires a signal from the surface only for test initiation. A downhole controller and processor (not shown) carry out all subsequent control. The power supply may be a generator driven by a mud motor (not shown) or it may be any other suitable power source. Also included are multiple stabilizers 308 and 310 for stabilizing the tool section of the drill string 206 and packers 304 and 306 for sealing a portion of the annulus. A circulation valve disposed preferably above the upper packer 304 is used to allow continued circulation of drilling mud above the packers 304 and 306 while rotation of the drill bit is stopped. A separate vent or equalization valve (not shown) is used to vent fluid from the test volume between the packers 304 and 306 to the upper annulus. This venting reduces the test volume pressure, which is required for a drawdown test. It is also contemplated that the pressure between the packers 304 and 306 could be reduced by drawing fluid into the system or venting fluid to the lower annulus, but in any case some method of increasing the volume of the intermediate annulus to decrease the pressure will be required.

Figure 1:
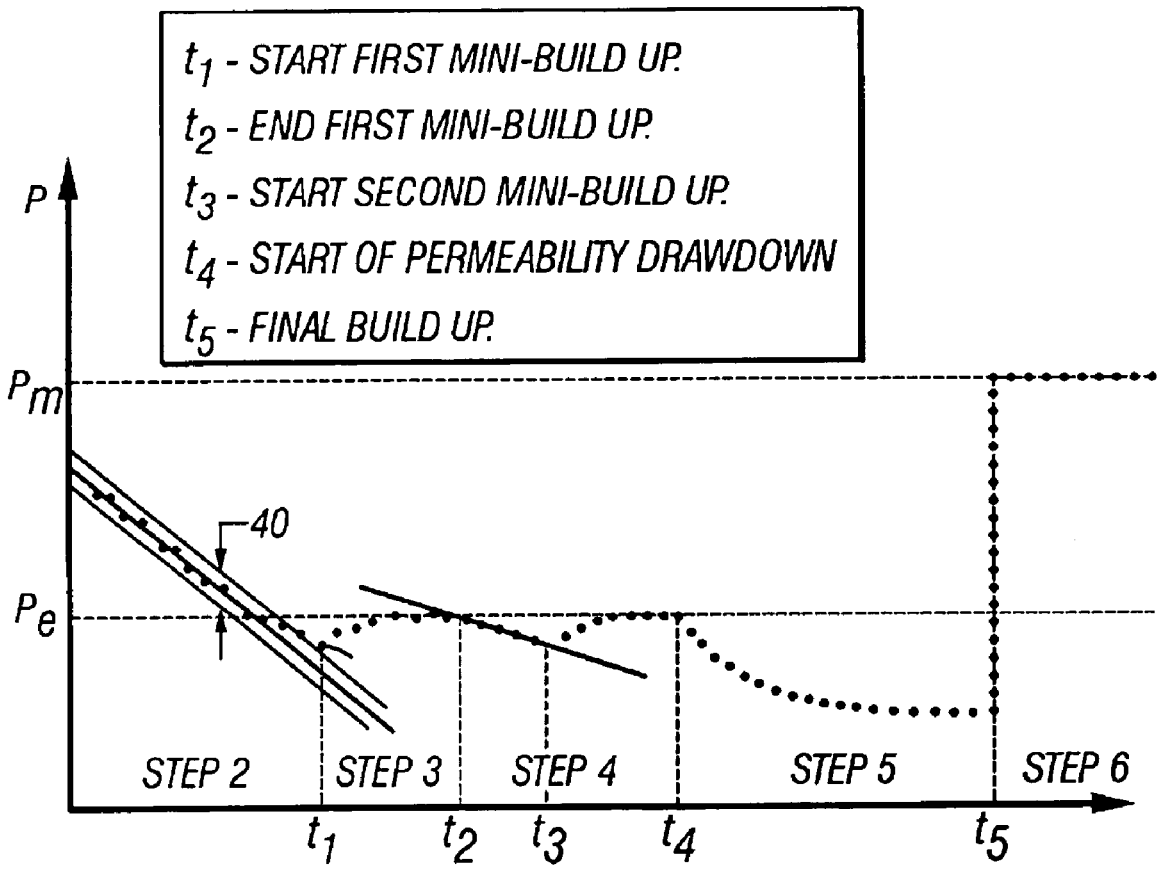
FIG. 1 (Prior Art)
FIG. 1 is a graphical qualitative representation a formation pressure test using a particular prior art method.

In one embodiment of the present invention an extendable pad-sealing element 302 for engaging the well wall 4 (FIG. 1) is disposed between the packers 304 and 306 on the test apparatus 216. The pad-sealing element 302 could be used without the packers 304 and 306, because a sufficient seal with the well wall can be maintained with the pad 302 alone. If packers 304 and 306 are not used, a counterforce is provided so pad 302 can maintain sealing engagement with the wall of the borehole 204. The seal creates a test volume at the pad seal and extending only within die tool to the pump rather than also using the volume between packer elements.

One way to ensure the seal is maintained is to ensure greater stability of the drill string 206. Selectively extendable gripper elements 312 and 314 could be incorporated into the drill string 206 to anchor the drill string 206 during the test. The grippers 312 and 314 are shown incorporated into the stabilizers 308 and 310 in this embodiment. The grippers 312 and 314, which would have a roughened end surface for engaging the well wall, would protect soft components such as the pad-sealing element 302 and packers 304 and 306 from damage due to tool movement. The grippers 312 would be especially desirable in offshore systems such as the one shown in FIG. 2, because movement caused by heave can cause premature wear out of sealing components.

Figure 4:
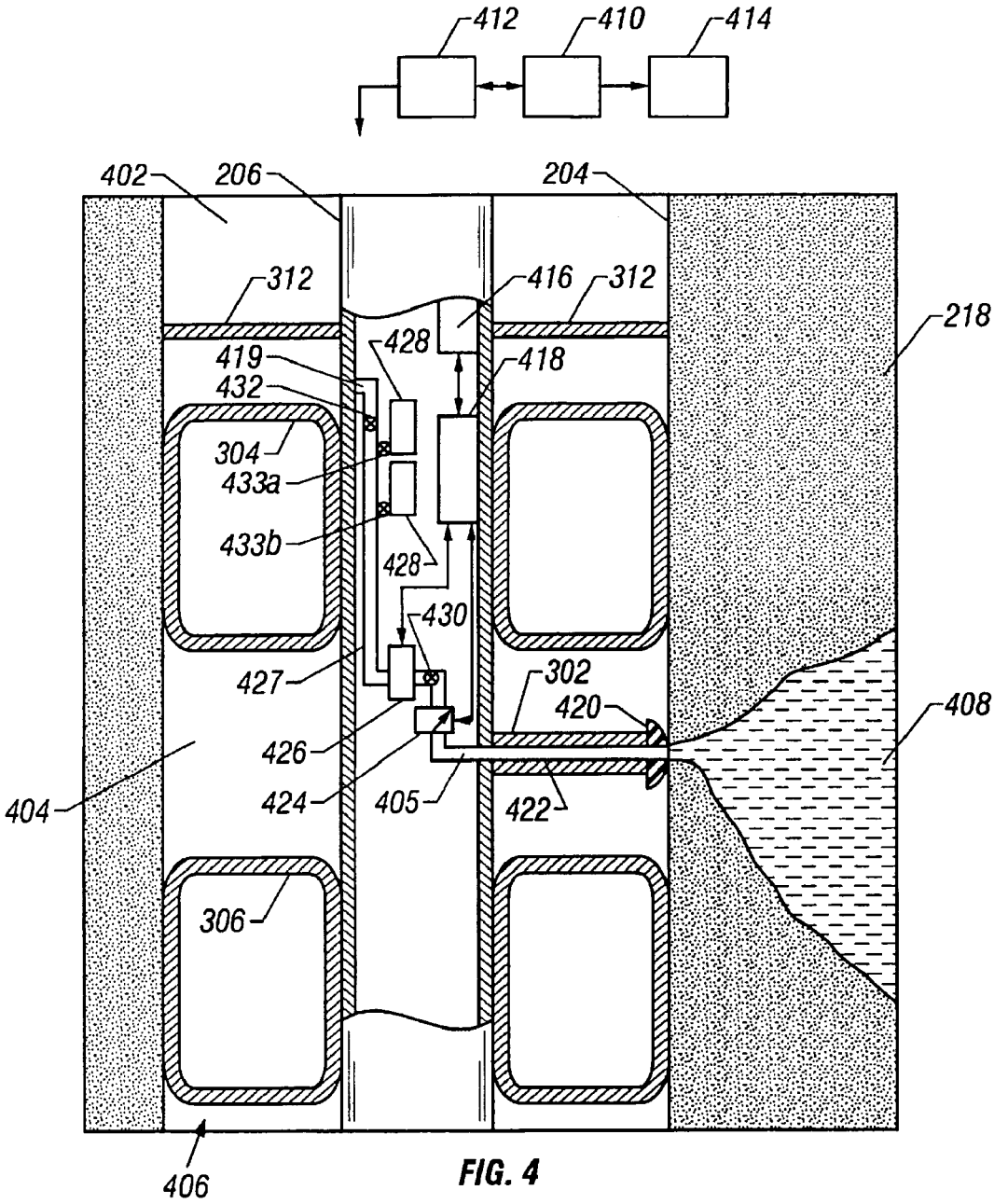
FIG. 4 is a system schematic of the present invention.

FIG. 4 shows the tool of FIG. 3 schematically with internal downhole and surface components. Selectively extendable gripper elements 312 engage the borehole wall 204 to anchor the drill string 206. Packer elements 304 and 306 well known in the art extend to engage the borehole wall 204. The extended packers separate the well annulus into three sections, an upper annulus 402, an intermediate annulus 404 and a lower annulus 406. The sealed annular section (or simply sealed section) 404 is adjacent a formation 218. Mounted on the drill string 206 and extendable into the sealed section 404 is the selectively extendable pad sealing element 302. A fluid line providing fluid communication between pristine formation fluid 408 and tool sensors such as pressure sensor 424 is shown extending through the pad member 302 to provide a port 420 in the sealed annulus 404. The preferable configuration to ensure pristine fluid is tested or sampled is to have packers 304 and 306 sealingly urged against the wall 204, and to have a sealed relationship between the wall and extendable element 302. Reducing the pressure in sealed section 404 prior to engaging the pad 302 will initiate fluid flow from the formation into the sealed section 404. With formation flowing when the extendable element 302 engages the wall, the port 420 extending through the pad 320 will be exposed to pristine fluid 408. Control of the orientation of the extendable element 302 is highly desirable when drilling deviated or horizontal wells. The exemplary orientation is toward an upper portion of the borehole wall. A sensor 214, such as an accelerometer, can be used to sense the orientation of the extendable element 302. The extendable element can then be oriented to the desired direction using methods and not-shown components well known in the art such as directional drilling with a bend-sub. For example, the drilling apparatus may include a drill string 206 rotated by a surface rotary drive (not shown). A downhole mud motor (see FIG. 2 at 210) may be used to independently rotate the drill bit. The drill string can thus be rotated until the extendable element is oriented to the desired direction as indicated by the sensor 214. The surface rotary drive is halted to stop rotation of the drill string 206 during a test, while rotation of the drill bit may be continued using the mud motor.

A downhole controller 418 preferably controls the test. The controller 418 is connected to at least one system volume control device (pump) 426. The pump 426 is a preferably small piston driven by a ball screw and stepper motor or other variable control motor, because of the ability to iteratively change the volume of the system. The pump 426 may also be a progressive cavity pump. When using other types of pumps, a flow meter should also be included. A valve 430 for controlling fluid flow to the pump 426 is disposed in the fluid line 422 between a pressure sensor 424 and the pump 426. A test volume 405 is the volume below the retracting piston of the pump 426 and includes the fluid line 422. The pressure sensor is used to sense the pressure within the test volume 404. It should be noted here that the test could be equally valuable if performed with the pad member 302 in a retracted position. In this case, the text volume includes the volume of the intermediate annulus 404. This allows for a "quick" test, meaning that no time for pad extension and retraction would be required. The sensor 424 is connected to the controller 418 to provide the feedback data required for a closed loop control system. The feedback is used to adjust parameter settings such as a pressure limit for subsequent volume changes. The downhole controller incorporates a processor (not separately shown) for further reducing test time, and an optional database and storage system could be incorporated to save data for future analysis and for providing default settings.

When drawing down the sealed section 404, fluid is vented to the upper annulus 402 via an equalization valve 419. A conduit 427 connecting the pump 426 to the equalization valve 419 includes a selectable internal valve 432. If fluid sampling is desired, the fluid may be diverted to optional sample reservoirs 428 by using the internal valves 432, 433*a*, and 433*b* rather than venting through the equalization valve 419. For typical fluid sampling, the fluid contained in the reservoirs 428 is retrieved from the well for analysis.

A exemplary embodiment for testing low mobility (tight) formations includes at least one pump (not separately shown) in addition to the pump 426 shown. The second pump should have an internal volume much less than the internal volume of the primary pump 426. A suggested volume of the second pump is 1/100 the volume of the primary pump. A typical "T" connector having selection valve controlled by the downhole controller 418 may be used to connect the two pumps to the fluid line 422.

In a tight formation, the primary pump is used for the initial draw down. The controller switches to the second pump for operations below the formation pressure. An advantage of the second pump with a small internal volume is that build-up times are faster than with a pump having a larger volume.

Results of data processed downhole may be sent to the surface in order to provide downhole conditions to a drilling operator or to validate test results. The controller passes processed data to a two-way data communication system 416 disposed downhole. The downhole system 416 transmits a data signal to a surface communication system 412. There are several methods and apparatus known in the art suitable for transmitting data. Any suitable system would suffice for the purposes of this invention. Once the signal is received at the surface, a surface controller and processor 410 converts and transfers the data to a suitable output or storage device 414. As described earlier, the surface controller 410 and surface communication system 412 is also used to send the test initiation command.

Figure 5:
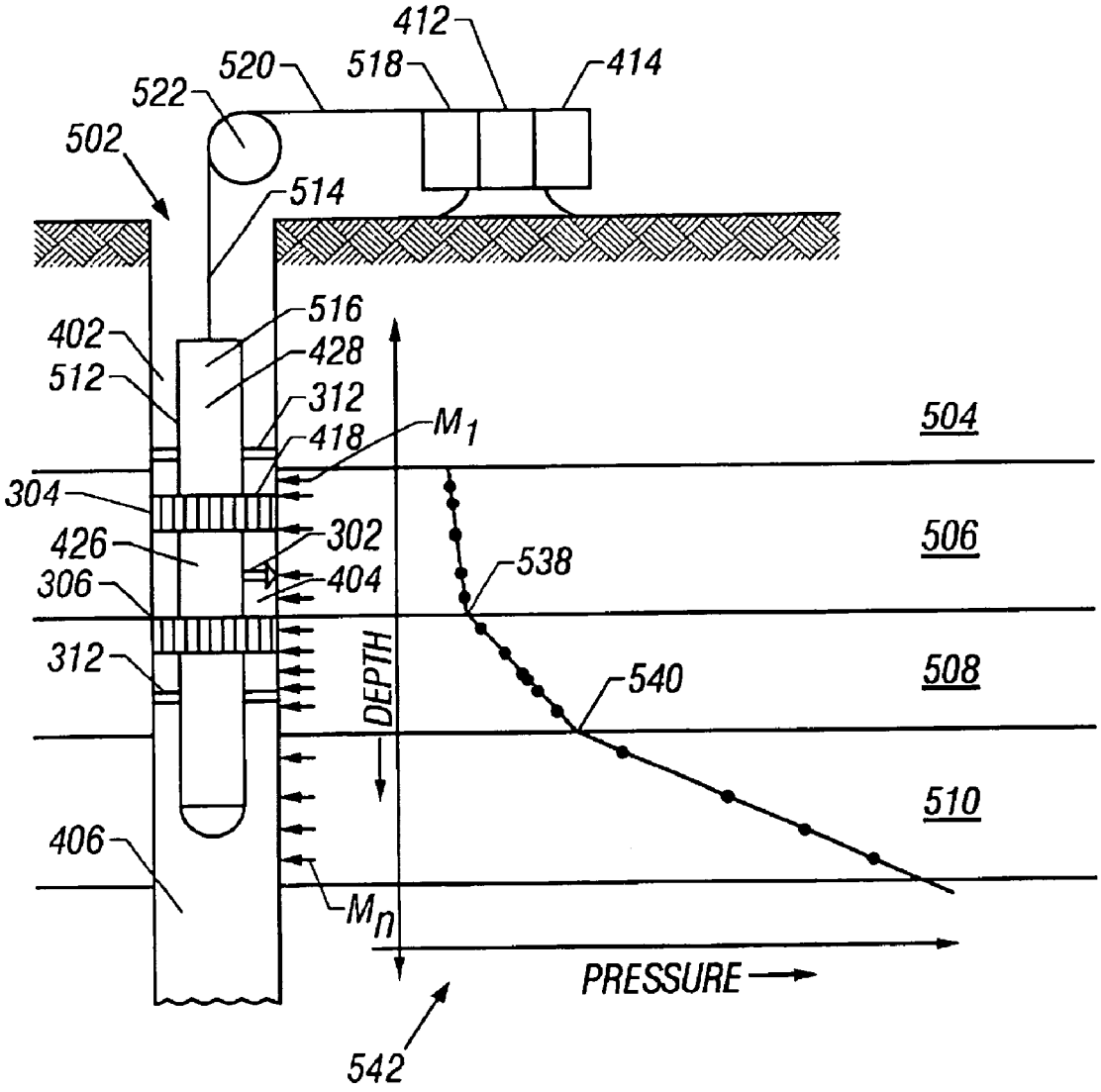
FIG. 5 is an elevation view of a wireline embodiment according to the present invention.

FIG. 5 is a wireline embodiment according to the present invention. A well 502 is shown traversing a formation 504 containing a reservoir having gas 506, oil 508 and water 510 layers. A wireline tool 512 supported by an armored cable 514 is disposed in the well 502 adjacent the formation 504. Extending from the tool 512 are optional grippers 312 for stabilizing the tool 512. Two expandable packers 304 and 306 are disposed on the tool 512 are capable of separating the annulus of the borehole 502 into an upper annulus 402, a sealed intermediate annulus 404 and a lower annulus 406. A selectively extendable pad member 302 is disposed on the tool 512. The grippers 312, packers 304 and 306, and extendable pad element 302 are essentially the same as those described in FIGS. 3 and 4, therefore the detailed descriptions are not repeated here.

Telemetry for the wireline embodiment is a downhole two-way communication unit 516 connected to a surface two-way communication unit 518 by one or more conductors 520 within the armored cable 514. The surface communication unit 518 is housed within a surface controller that includes a processor 412 and output device 414 as described in FIG. 4. A typical cable sheave 522 is used to guide the armored cable 514 into the borehole 502. The tool 512 includes a downhole processor 418 for controlling formation tests in accordance with methods to be described in detail later.

The embodiment shown in FIG. 5 is desirable for determining contact points 538 and 540 between the gas 506 and oil 508 and between the oil 508 and water 510. To illustrate this application a plot 542 of pressure vs. depth is shown superimposed on the formation 504. The downhole tool 512 includes a pump 426, a plurality of sensors 424 and optional sample tanks 428 as described above for the embodiment shown in FIG. 4. These components are used to measure formation pressure at varying depths within the borehole 502. The pressures plotted as shown are indicative of fluid or gas density, which varies distinctly from one fluid to the next. Therefore, having multiple pressure measurements $M_1$–$M_n$ provides data necessary to determine the contact points 538 and 540.

Measurement strategies and calculation procedures for determining effective mobility ($k/\mu$) in a reservoir according to the present invention are described below. Measurement times are fairly short, and calculations are robust for a large range of mobility values. The initial pressure drawdown employs a much lower pump withdrawal rate, 0.1 to 0.2 $cm^3/s$, than rates typically used currently. Using lower rates reduces the probability of formation damage due to fines migration, reduces temperature changes related to fluid expansion, reduces inertial flow resistance, which can be substantial in probe permeability measurements, and permits rapid attainment of steady-state flow into the probe for all but very low mobilities.

Steady state flow is not required for low mobility values (less than about 2 md/cp). For these measurements, fluid compressibility is determined from the initial part of the drawdown when pressure in the probe is greater than formation pressure. Effective mobility and distant formation pressure, p*, are determined from the early portion of the pressure buildup, by methods presented herein, thus eliminating the need for the lengthy final portion of the buildup in which pressure gradually reaches a constant value.

For higher mobilities, where steady-state flow is reached fairly quickly during the drawdown, the pump is stopped to initiate the rapid pressure buildup. For a mobility of 10 md/cp, and the conditions used for the sample calculations described later herein (including a pump rate of 0.2 $cm^3/s$), steady-state flow occurs at a drawdown of about 54 psi below formation pressure. The following buildup (to within 0.01 psi of formation pressure) requires only about 6 seconds. The drawdown is smaller and the buildup time is shorter (both inversely proportional) for higher mobilities. Mobility can be calculated from the steady-state flowrate and the difference between formation and drawdown pressures. Different pump rates can be used to check for inertial flow resistance. Instrument modifications may be required to accommodate the lower pump rates and smaller pressure differentials.

Referring to FIG. 4, after the packers 304 and 306 are set and the pump piston is in its initial position with a full withdrawal stroke remaining, the pump 426 is started preferably using a constant rate ($q_{pump}$). The probe and connecting lines to the pressure gauge and pump comprise the "system volume," $V_{sys}$ which is assumed to be filled with a uniform fluid, e.g., drilling mud. As long as pressure in the probe is greater than the formation pressure, and the formation face at the periphery of the borehole is sealed by a mud cake, no fluid should flow into the probe. Assuming no leaks past the packer and no work-related expansional temperature decreases, pressure in the "system," at the datum of the pressure gauge, is governed by fluid expansion, equal to the pump withdrawal volume. Where $A_p$ is the cross sectional area of a pump piston, x is the travel distance of the piston, C is fluid compressibility, and p is system pressure, the rate of pressure decline depends on the volumetric expansion rate as shown in equation 1:

$$q_{pump} = A_p\left(\frac{dx}{dt}\right) = \frac{dV_p}{dt} = -CV_{sys}\left(\frac{dp}{dt}\right) \tag{1}$$

Equation 2 shows the system volume increases as the pump piston is withdrawn:

$$V_{sys}[t]=V_0+(x[t]-x_o)A_p=V_0+V_p[t] \tag{2}$$

and differentiation of Eq. 2 shows that:

$$\frac{dV_{sys}}{dt} = \frac{dV_p}{dt} \tag{3}$$

Therefore, substituting the results of Eq. 3 into Eq. 1 and rearranging:

$$\frac{-dV_{sys}}{CV_{sys}} \equiv \frac{-d\ \ln V_{sys}}{c} = dp \tag{4}$$

For constant compressibility, Eq. 4 can be integrated to yield pressure in the probe as a function of system volume:

$$P_n = P_{n-1} + \frac{1}{C}\ln\left[\frac{V_{sys_{n-1}}}{V_{sys_n}}\right]. \tag{5}$$

Pressure in the probe can be related to time by calculating the system volume as a function of time from Eq. 2. Conversely, if compressibility is not constant, its average value between any two system volumes is:

$$C_{avg} = \frac{\ln\left[\frac{V_{sys_{n-1}}}{V_{sys_n}}\right]}{P_2 - P_1} \tag{6}$$

where subscripts 1 and 2 are not restricted to being consecutive pairs of readings. Note that if temperature decreases during the drawdown, the apparent compressibility will be too low. A sudden increase in compressibility may indicate a pumping problem such as sanding, the evolution of gas or a leak past the packer on the seal between the probe face and the bore hole wall. The calculation of compressibility, under any circumstances, is invalid whenever pressure in the probe is less than formation pressure when fluid can flow into the probe giving the appearance of a marked increase in compressibility. Note, however, that compressibility of real fluids almost invariably increases slightly with decreasing pressure.

Figure 6:
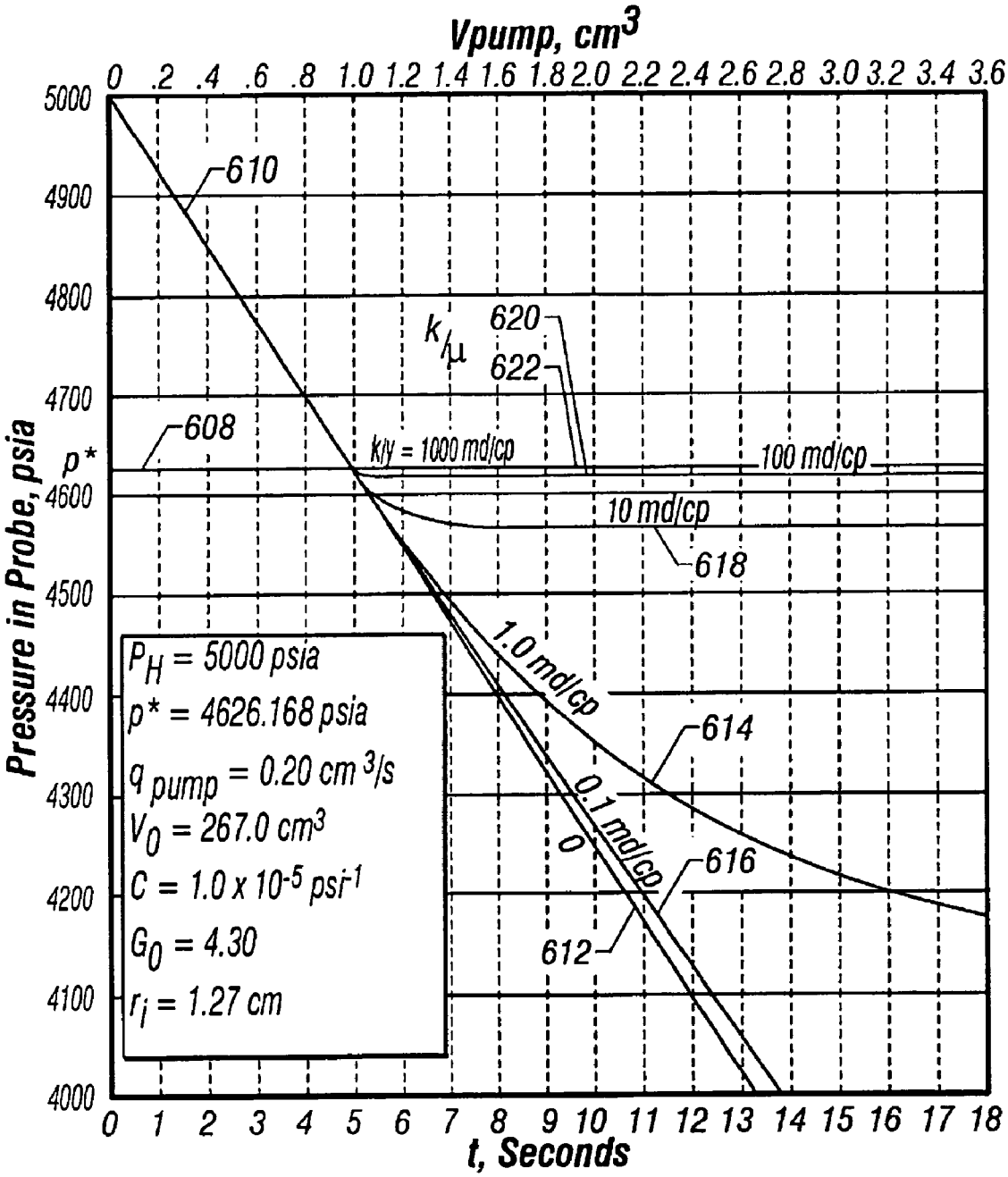
FIG. 6 is a plot graph of pressure vs. time and pump volume showing predicted drawdown behavior using specific parameters for calculation.

FIG. 6 shows an example of drawdown from an initial hydrostatic borehole pressure of 5000 psia to (and below) a reservoir pressure (p*) 608 of 4626.168 psia, calculated using the following conditions as an example:

Effective probe radius, $r_i$, of 1.27 cm;

Dimensionless geometric factor, $G_0$, of 4.30;

Initial system volume, $V_0$, of 267.0 $cm^3$;

Constant pump volumetric withdrawal rate $q_{pump}$ of 0.2 $cm^3/s$; and

Constant compressibility, C, of $1\times10^{-5}$ $psi^{-1}$.

The calculation assumes no temperature change and no leakage into the probe. The pressure drawdown is shown as a function of time or as a function of pump withdrawal volume, shown at the bottom and top respectively of the FIG. 6. The initial portion 610 of the drawdown (above p*) is calculated from Eq. 5 using $V_{sys}$ calculated from Eq. 2. Continuing the drawdown below reservoir pressure for no flow into the probe is shown as the "zero" mobility curve 612. Note that the entire "no flow" drawdown is slightly curved, due to the progressively increasing system volume.

Normally, when pressure falls below p* and permeability is greater than zero, fluid from the formation starts to flow into the probe. When p=p* the flow rate is zero, but gradually increases as p decreases. In actual practice, a finite difference may be required before the mud cake starts to slough off the portion of the borehole surface beneath the interior radius of the probe packer seal. In this case, a discontinuity would be observed in the time-pressure curve, rather than the smooth departure from the "no flow" curve as shown in FIG. 6. As long as the rate of system-volume-increase (from the pump withdrawal rate) exceeds the rate of fluid flow into the probe, pressure in the probe will continue to decline. Fluid contained in $V_{sys}$ expands to fill the flow rate deficit. As long as flow from the formation obeys Darcy's law, it will continue to increase, proportionally to (p*−p). Eventually, flow from the formation becomes equal to the pump rate, and pressure in the probe thereafter remains constant. This is known as "steady state" flow.

The equation governing steady state flow is:

$$\frac{k}{\mu} = \frac{14{,}696 q_{pump}}{G_0 r_i (p^* - p_{ss})} \tag{7}$$

For the conditions given for FIG. 6, the steady state drawdown pressure difference, $p^*-p_{ss}$, is 0.5384 psi for $k/\mu=1000$ md/cp, 5.384 psi for 100 md/cp, 53.84 psi for 10 md/cp, etc. For a pump rate of 0.1 $cm^3/s$, these pressure differences would be halved; and they would be doubled for a pump rate of 0.4 $cm^3/s$, etc.

As will be shown later, these high mobility drawdowns have very fast pressure buildups after the pump-piston withdrawal is stopped. The value of p* can be found from the stabilized buildup pressure after a few seconds. In the case of high mobilities ($k/\mu>50$ md/cp), the pump rate may have to be increased in subsequent drawdown(s) to obtain an adequate drawdown pressure difference ($p^*-p$). For lower mobilities, it should be reduced to ascertain that inertial flow resistance (non-Darcy flow) is not significant. A total of three different pump rates would be desirable in these cases.

Steady-state calculations are very desirable for the higher mobilities because compressibility drops out of the calculation, and mobility calculations are straight forward. However, instrument demands are high: 1) pump rates should be constant and easy to change, and 2) pressure differences ($p^*-p_{ss}$) are small. It would be desirable to have a small piston driven by a ball screw and stepper motor to control pressure decline during the approach to steady state flow for low mobilities.

FIG. 6 shows that within the time period illustrated, the drawdown for the 1.0 md/cp curve 614 and lower mobilities did not reach steady state. Furthermore, the departures from the zero mobility curve for 0.1 md/cp 616 and below, are barely observable. For example, at a total time of 10 seconds, the drawdown pressure difference for 0.01 md/cp is only 1.286 psi less than that for no flow. Much greater pressure upsets than this, due to nonisothermal conditions or to small changes in fluid compressibility, are anticipated. Drawdowns greater than 200–400 psi below p* are not recommended: significant inertial flow resistance (non-Darcy flow) is almost guaranteed, formation damage due to fines migration is likely, thermal upsets are more significantly unavoidable, gas evolution is likely, and pump power requirements are increased. During the period when $p<p^*$, and before steady state flow is attained, three rates are operative: 1) the pump rate, which increases the system volume with time, 2) fluid flow rate from the formation into the probe, and 3) the rate of expansion of fluid within the system volume, which is equal to the difference between the first two rates. Assuming isothermal conditions, Darcy flow in the formation, no permeability damage near the probe face, and constant viscosity, drawdown curves for 10, 1, and 0. 1 md/cp mobilities 618, 614 and 616, shown for FIG. 6, are calculated from an equation based on the relationship of these three rates as discussed above:

$$p_n = p_{n-1} + \frac{q_{f_n}(t_n - t_{n-1}) - (V_{pump_n} - V_{pump_{n-1}})}{C\left[V_0 + \frac{1}{2}(V_{pump_n} + V_{pump_{n-1}})\right]} \tag{8}$$

wherein, the flow rate into the probe from the formation at time step n, is calculated from:

$$q_{f_n} = \frac{kG_0 r_i\left[p* - \frac{1}{2}(p_{n-1} + p_n)\right]}{14{,}696\mu} \tag{9}$$

Because $p_n$ is required for the calculation of $q_{f_n}$ in Eq. 9, which is required for the solution of Eq. 8, an iterative procedure was used. For the lower mobilities, convergence was rapid when using $p_{n-1}$ as the first guess for p. However, for the 10 md/cp curve, many more iterations were required for each time step, and this procedure became unstable for the 100 md/cp and higher mobility cases. Smaller time steps, and/or much greater damping (or a solver technique, rather than an iterative procedure) is required.

The pump piston is stopped (or slowed) to initiate the pressure buildup. When the piston is stopped, the system volume remains constant, and flow into the probe from the formation causes compression of fluid contained in the system volume and the consequent rise in pressure. For high mobility measurements, for which only steady-state calculations are performed, determination of fluid compressibility is not required. The buildup is used only to determine p*, so the pump is completely stopped for buildup. For the conditions given for FIG. 6, the buildup time, to reach within 0.01 psi of p* is about 6, 0.6, and 0.06 seconds for mobilities of 10, 100 and 1000 md/cp 618, 620 and 622, respectively.

For low mobility measurements, in which steady state was not reached during the drawdown, the buildup is used to determine both p * and $k/\mu$. However, it is not necessary to measure the entire buildup. This takes an unreasonable length of time because at the tail of the buildup curve, the driving force to reach p* approaches zero. A technique for avoiding this lengthy portion of the measurement will be presented in the next section.

The equation governing the pressure buildup, assuming constant temperature, permeability, viscosity, and compressibility, is:

$$\frac{kG_0 r_i (p^* - p)}{14{,}696\mu} = -CV_{sys}\left(\frac{dp}{dt}\right). \tag{10}$$

Rearranging and integrating yields:

$$t - t_0 = \frac{14{,}696\mu C V_{sys}}{kG_0 r_i}\ln\left(\frac{p^* - p_0}{p^* - p}\right). \tag{11}$$

where $t_0$ and $p_0$, are the time and pressure in the probe, respectively, at the start of the buildup, or at any arbitrary point in the buildup curve.

Figure 7:
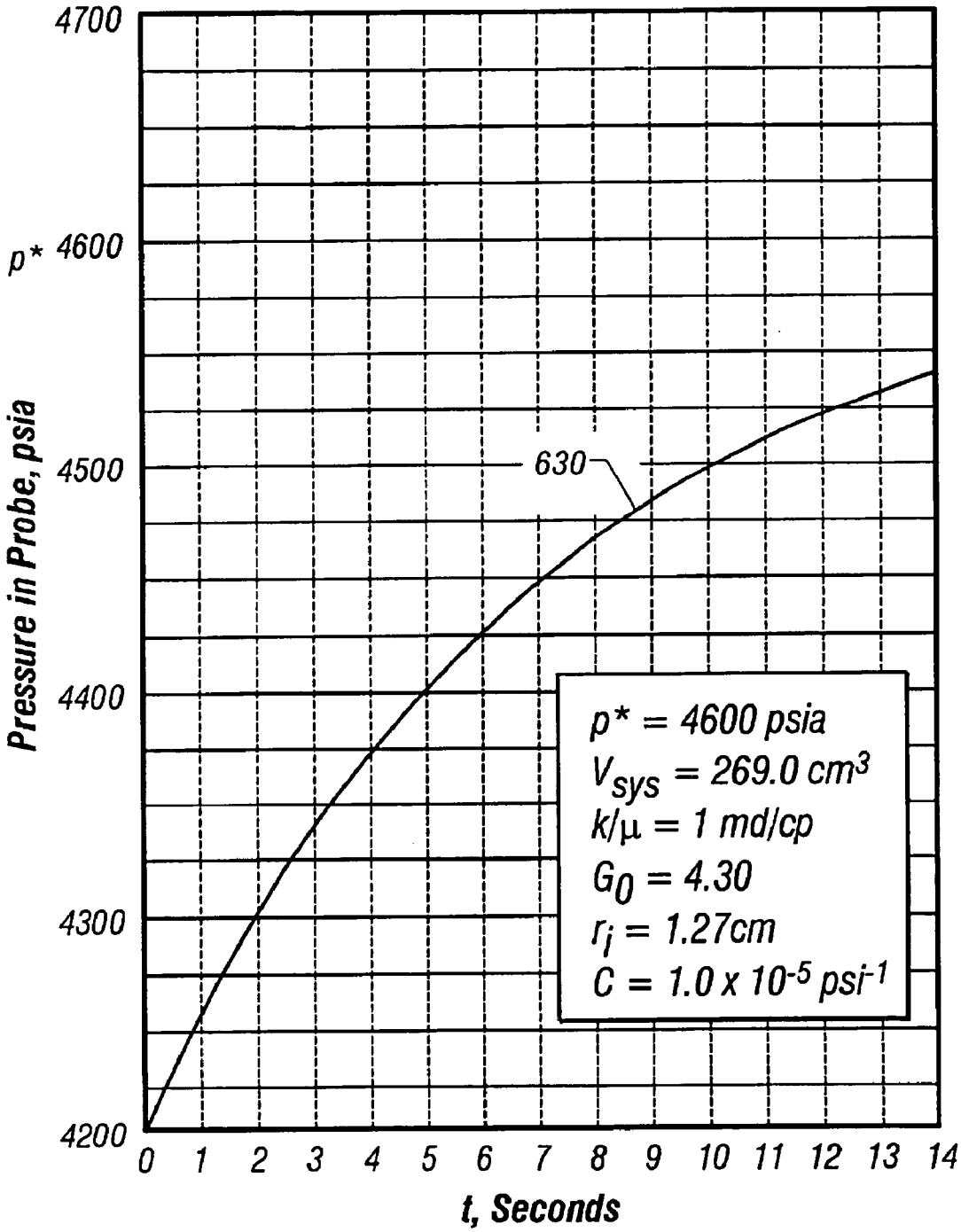
FIG. 7 is a plot graph of pressure vs. time showing the early portion of a pressure buildup curve for a moderately low permeability formation.

FIG. 7 is a plot of the early portion of a buildup curve 630 for a 1 md/cp mobility, which starts at 4200 psia, and if run to completion, would end at a p* of 4600. This is calculated from Eq. 11. In addition to the other parameters shown on this figure, $p_o$=4200 psia.

Determining p* from an incomplete buildup curve can be described by way of an example. Table 2 represents hypothetical experimental data. The challenge is to determine accurately the value of p*, which would not otherwise be available. To obtain p* experimentally would have taken at least 60 s, instead of the 15 s shown. The only information known in the hypothetical are the system values for FIG. 6 and $V_{sys}$ of 269.0 $cm^3$. The compressibility, C, is determined from the initial drawdown data starting at the hydrostatic borehole pressure, using Eq. 6.

TABLE 2

Hypothetical Pressure Buildup Data From A Moderately Low Permeability Reservoir

| $t - t_0$, s | p, psia |
|---|---|
| 0.0000 | 4200 |
| 0.9666 | 4250 |
| 2.0825 | 4300 |
| 3.4024 | 4350 |
| 5.0177 | 4400 |
| 5.9843 | 4425 |
| 7.1002 | 4450 |
| 8.4201 | 4475 |
| 10.0354 | 4500 |
| 12.1179 | 4525 |
| 15.0531 | 4550 |

The first group on the right side of Eq. 11 and preceding the logarithmic group can be considered the time constant, τ, for the pressure buildup. Thus, using this definition, and rearranging Eq. 11 yields:

$$\ln\left(\frac{p^* - p_0}{p^* - p}\right) = \left(\frac{1}{\tau}\right)(t - t_0), \tag{12}$$

Figure 8:
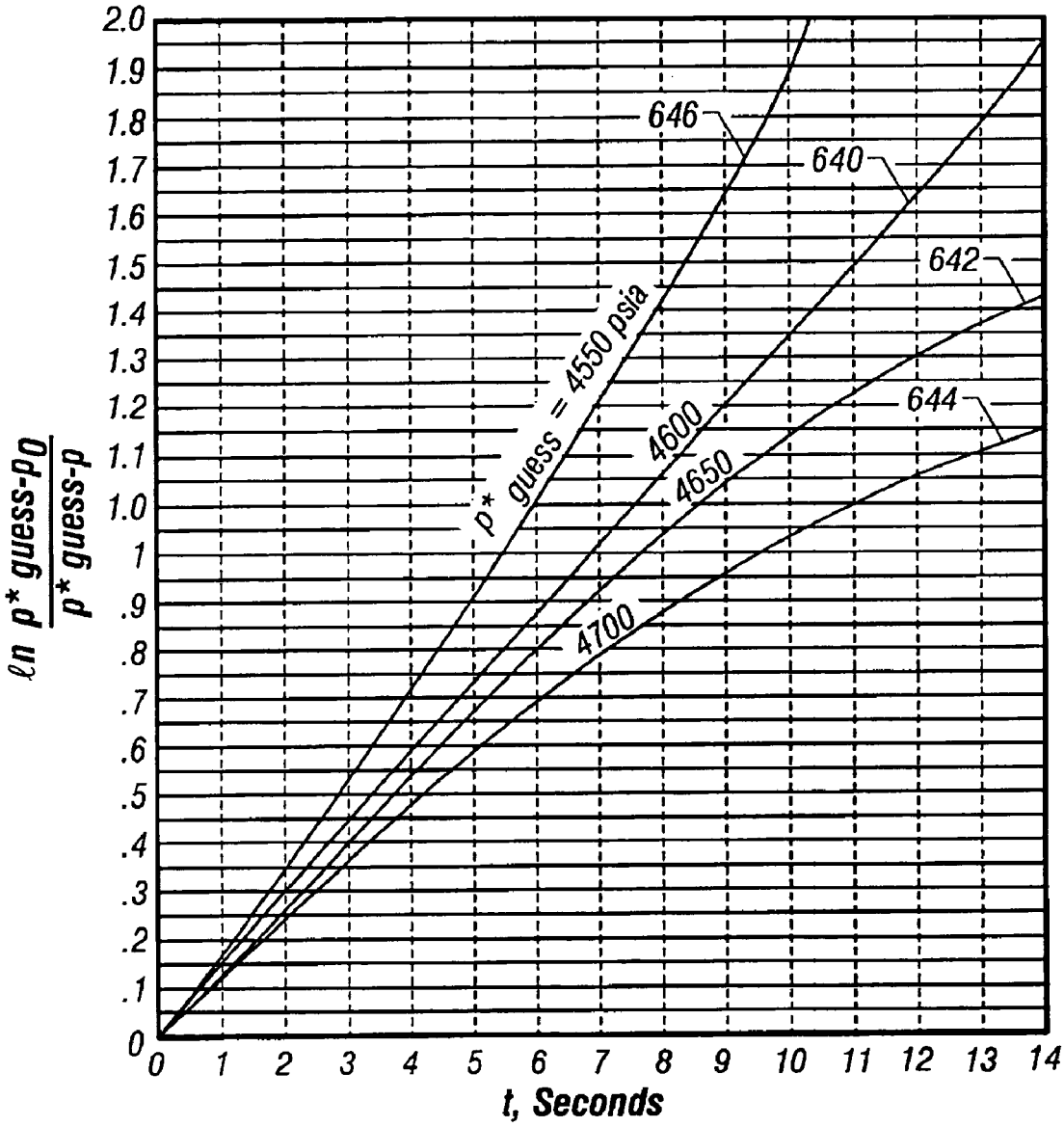
FIG. 8 is a plot graph of a method using iterative guesses for determining formation pressure.

A plot of the left side of Eq. 12 vs. $(t-t_0)$ is a straight line with slope equal to $(1/\tau)$, and intercept equal to zero. FIG. 8 is a plot of data from Table 2, using Eq. 12 with various guesses for the value of p*. We can see that only the correct value, 4600 psia, yields the required straight line 640. Furthermore, for guesses that are lower than the correct p*, the slope of the early-time portion of a curve 646 is smaller than the slope at later times. Conversely, for guesses that are too high, the early-time slope is larger than late-time slopes for the curves 642 and 644.

These observations can be used to construct a fast method for finding the correct p*. First, calculate the average slope from an arbitrary early-time portion of the data shown in Table 2. This slope calculation starts at $t_1$, and $p_1$, and ends at $t_2$ and $p_2$. Next calculate the average late-time slope from a later portion of the table. The subscripts for beginning and end of this calculation would be 3 and 4, respectively. Next divide the early-time slope by the late-time slope for a ratio R:

$$R = \frac{\ln\left(\frac{p^* - p_1}{p^* - p_2}\right)(t_4 - t_3)}{\ln\left(\frac{p^* - p_3}{p^* - p_4}\right)(t_2 - t_1)} \tag{13}$$

Figure 9:
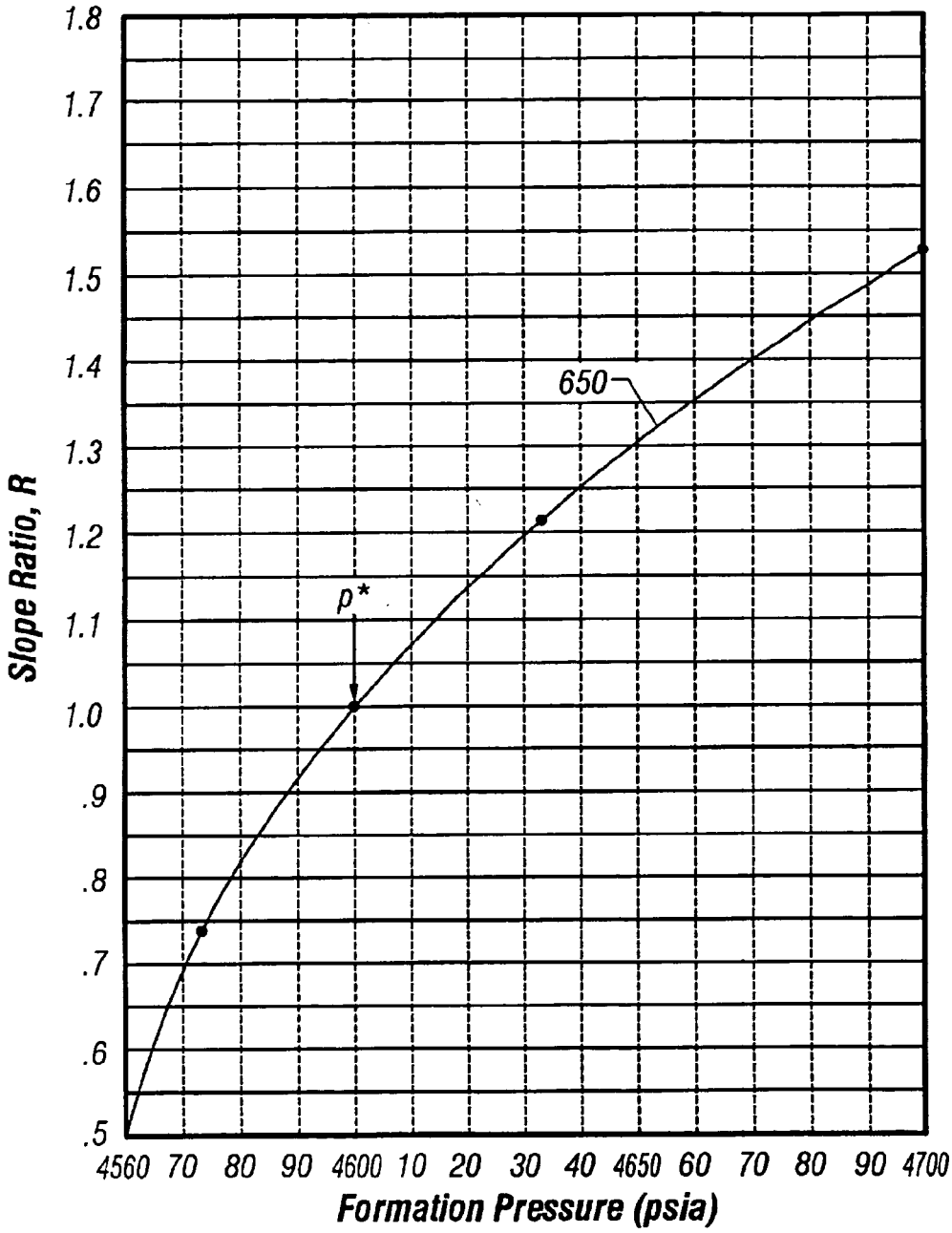
FIG. 9 is a plot graph of a method for finding formation pressure using incomplete pressure buildup data.

Suppose we choose the second set of data points from Table 2: 2.0825 s and 4300 psia for the beginning of the early-time slope. Suppose further that we select data from sets 5, 9, and 11 as the end of the early time slope, and beginning and end of the late-time slope, respectively, with corresponding subscripts 2, 3, and 4. If we now guess that p* is 4700 psia, then insert these numbers into Eq. 13, the calculated value of R is 1.5270. Because this is greater than 1, the guess was too high. Results of this and other guesses for p* while using the same data above are shown as a curve plot 650 in FIG. 9. The correct value of p*, 4600 psia, occurs at R=1. These calculations can easily be incorporated into a solver routine, which converges rapidly to the correct p* without plots. Mobility, having found the correct p*, is calculated from a rearrangement of Eq. 11, using the compressibility obtained from the initial hydrostatic drawdown.

In general, for real data, the very early portion of the buildup data should be avoided for the calculations of p*, then k/μ. This fastest portion of the buildup, with high pressure differences, has the greatest thermal distortion due to compressive heating, and has the highest probability of non-Darcy flow. After p* has been determined as described above, the entire data set should be plotted per FIG. 7. Whenever the initial portion of the plot displays an increasing slope with increasing time, followed by a progressively more linear curve, this may be a strong indication of non-Darcy flow at the higher pressure differences.

Figure 10:
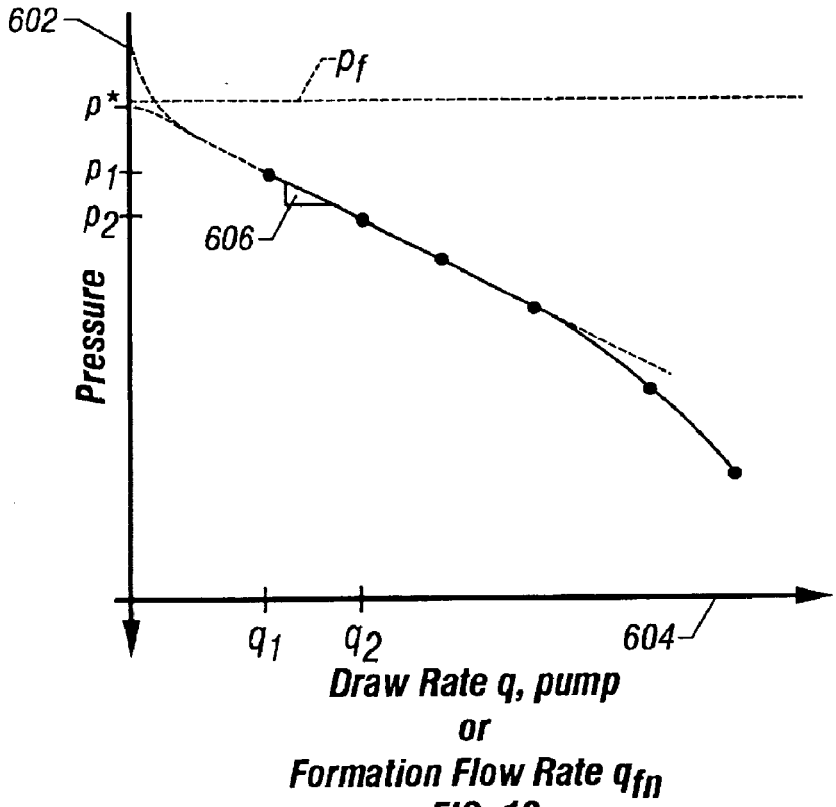
FIG. 10 is a plot graph of pressure vs. draw rate illustrating a computation technique used in a method according to the present invention to determine formation pressure.

Another method according to the present invention can be described with reference to FIG. 10. FIG. 10 shows a relationship between tool pressure 602 and formation flow rate $q_{fn}$ 604 along with the effect of rates below and above certain limits. Darcy's Law teaches that pressure is directly proportional to fluid flow rate in the formation. Thus, plotting pressure against a drawdown piston draw rate will form a straight line when the pressure in the tool is constant while the piston is moving at a given rate. Likewise, the plot of flow rates and stabilized pressures will form a straight line, typically with a negative slope (m) 606, between a lower and an upper rate limit. The slope is used to determine mobility (k/μ) of fluid in the formation. Equation 8 can be rearranged for the formation flow rate:

$$q_{fn} = \frac{(V_{pump_n} - V_{pump_{n-1}}) - C \left[V_0 + \frac{1}{2}(V_{pump_n} + V_{pump_{n-1}})\right](p_{n-1} - p_n)}{(t_n - t_{n-1})} \tag{14}$$

Equation 14 is valid for non-steady-state conditions as well as steady-state conditions. Formation flow rate $q_{fn}$ can be calculated using Eq. 14 for non-steady-state conditions when C is known reasonably accurately to determine points along the plot of FIG. 10.

Steady-state conditions will simplify Eq. 14 because $(p_{n-1}-p_n)=0$. Under steady state conditions, known tool parameters and measured values may be used to determine points along the straight line region of FIG. 10. In this region, the pump rate $q_{pump}$ can be substituted. Then using $q_{pump}$ in equation 9 yields:

$$\frac{k}{\mu} = \frac{-14696}{mG_0 r_i} \tag{15}$$

In Eq. 15, $m=(p^*-p_{ss})/q_{pump}$. The units for $k/\mu$ are in md/cp, $p_n$ and $p^*$ are in psia, $r_i$ is in cm, $q_{fn}$ is in $cm^3/s$, $V_{pump}$ and $V_0$ are in $cm^3$, C is in $psi^{-1}$, and t is in s. Each pressure on the straight line is a steady state pressure at the given flow rate (or draw rate).

In practice, a deviation from a straight line near zero formation flow rate (filtrate) may be an indicator of drilling mud leakage into the tool (flow rate approximately zero). The deviation at high flow rates is typically a non-Darcy effect. However, the formation pressure can be determined by extending the straight line to an intercept with zero draw rate. The calculated formation pressure p* should equal a measured formation pressure within a negligible margin of error.

The purpose of a pressure test is to determine the pressure in the reservoir and determine the mobility of fluid in that reservoir. A procedure adjusting the piston draw rate until the pressure reading is constant (zero slope) provides the information to determine pressure and mobility independently of a "stable" pressure build up using a constant volume.

Some advantages of this procedure are quality assurance through self-validation of a test where a stable build up pressure is observed, and quality assurance through comparison of drawdown mobility with build up mobility. Also, when a build up portion of a test is not available (in the cases of lost probe seal or excessive build up time), p* provides the formation pressure.

Figure 11:
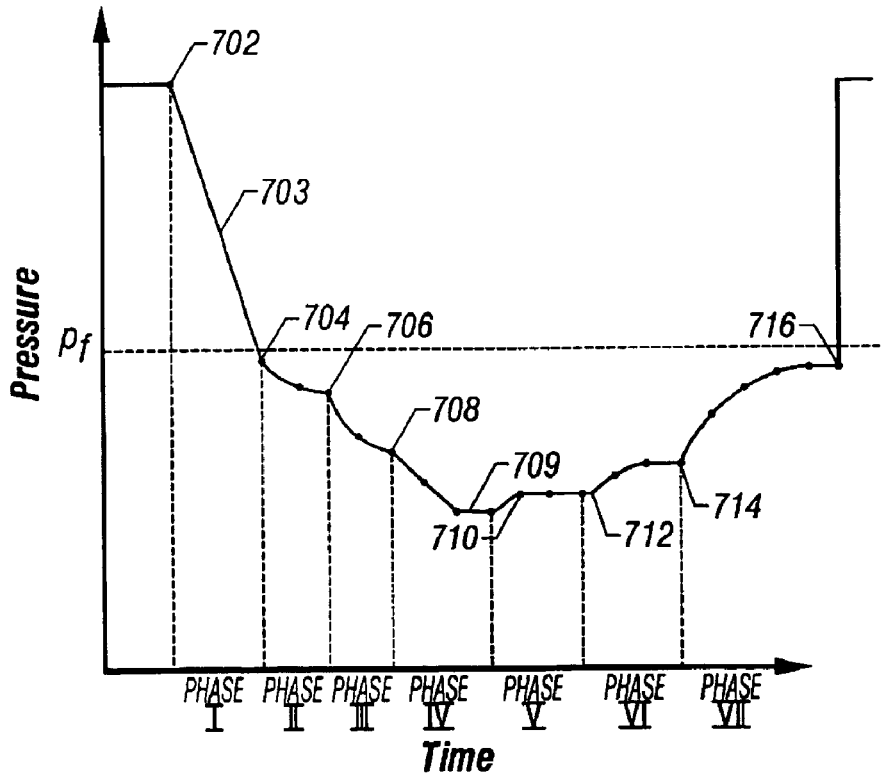
FIG. 11 is a graphical representation illustrating a method according to the present invention.

FIG. 11 is an exemplary plot of tool pressure vs. time using another method according to the present invention. The plot illustrates a method that involves changing the drawdown piston draw rate based on the slope of the pressure-time curve. Sensor data acquired at any point can be used with Eq. 14 to develop a plot as in FIG. 10 or used in automated solver routines controlled by a computer. Data points defining steady state pressures at various flow rates can be used to validate tests.

The procedure begins by using a MWD tool as described in FIG. 4 or a wireline tool as described in FIG. 5. A tool probe 420 is initially sealed against the borehole and the test volume 405 contains essentially only drilling fluid at the hydrostatic pressure of the annulus. Phase I 702 of the test is initiated by a command transmitted from the surface. A downhole controller 418 preferably controls subsequent actions. Using the controller to control a drawdown pump 426 that includes a drawdown piston, the pressure within the test volume is decreased at a constant rate by setting the draw rate of the drawdown piston to a predetermined rate. Sensors 424 are used to measure at least the pressure of the fluid in the tool at predetermined time intervals. The predetermined time intervals are adjusted to ensure at least two measurements can be made during each phase of the procedure. Additional advantages are gained by measuring the system volume, temperature and/or the rate of system volume change with suitable sensors. Compressibility of the fluid in the tool is determined during Phase I using the calculations discussed above.

Phase II of the test 704 begins when the tool pressure drops below the formation pressure p*. The slope of the pressure curve changes due to formation fluid beginning to enter the test volume. The change in slope is determined by using a downhole processor to calculate a slope from the measurements taken at two time intervals within the Phase. If the draw rate were held constant, the tool pressure would tend to stabilize at a pressure below p*.

The draw rate is increased at a predetermined time 706 to begin Phase 3 of the test. The increased draw rate reduces the pressure in the tool. As the pressure decreases, the flow rate of formation fluid into the tool increases. The tool pressure would tend to stabilize at a tool pressure lower than the pressure experienced during Phase II, because the draw rate is greater in Phase III than in Phase II. The draw rate is decreased again at a time 708 beginning Phase IV of the test when interval measurements indicate that pressure in the tool is approaching stabilization.

The draw rate may then be slowed or stopped so that pressure in the tool begins building. The curve slope changes sign when pressure begins to increase, and the change initiates Phase V 710 where the draw rate is then increased to stabilize the pressure. The stabilized pressure is indicated when pressure measurements yield zero slope. The draw down piston rate is then decreased for Phase VI 712 to allow buildup until the pressure again stabilizes. When the pressure is stabilized, the drawdown piston is stopped at Phase VII 714, and the pressure within the tool is allowed to build until the tool pressure stabilizes at the formation pressure $p_f$. The test is then complete and the controller equalizes the test volume 716 to the hydrostatic pressure of the annulus. The tool can then be retracted and moved to a new location or removed from the borehole.

Stabilized pressures determined during Phase V 710 and Phase VI, 712 along with the corresponding piston rates, are used by the downhole processor to determine a curve as in FIG. 10. The processor calculates formation pressure p* from the measured data points. The calculated value p* is then compared to measured formation pressure $p_f$ obtained by the tool during Phase VII 714 of the test. The comparison serves to validate the measured formation pressure $p_f$ thereby eliminating the need to perform a separate validation test.

Other embodiments using one or more of the method elements discussed above are also considered within the scope of this invention. Still referring to FIG. 11, another embodiment includes Phase I through Phase IV and then Phase VII. This method is desirable with moderately permeable formations when it is desired to measure formation pressure. Typically, there would be a slight variation in the profile for Phase IV in this embodiment. Phase VII would be initiated when measurements show a substantially zero slope on the pressure curve 709. The equalizing procedure 716 would also be necessary before moving the tool.

Another embodiment of the present invention includes Phase I 702, Phase II 704, Phase VI 712, Phase VII 714 and the equalization procedure 716. This method is used in very low permeability formations or when the probe seal is lost. Phase II would not be as distinct a deviation as shown, so the straight line portion 703 of Phase I would seem to extend well below the formation pressure $p_f$.

FIG. 12 is an illustration of a wire line formation sampling tool deployed in a well bore without packers. Turning now to FIG. 12 shows another embodiment of the present invention housed in a formation-testing instrument. FIG. 12 is an illustration of a formation-testing instrument taken from Michaels et al. U.S. Pat. No. 5,303,775 which is herein incorporated by reference in its entirety. The Michaels '775 patent teaches a method and apparatus is provided for use in connection with a downhole formation testing instrument for acquisition of a phase intact sample of connate fluid for delivery via a pressure containing sample tank to a laboratory facility. One or more fluid sample tanks contained within the instrument are pressure balanced with respect to the wellbore at formation level and are filled with a connate fluid sample in such manner that during filling of the sample tanks the pressure of the connate fluid is maintained within the predetermined range above the bubble point of the fluid sample. The sample tank incorporates an internal free-floating piston which separates the sample tank into sample containing and pressure balancing chambers with the pressure balancing chamber being in communication with borehole pressure. The sample tank is provided with a cut-off valve enabling the pressure of the fluid sample to be maintained after the formation testing instrument has been retrieved from the wellbore for transportation to a laboratory facility. To compensate for pressure decrease upon cooling of the sample tank and its contents, the piston pump mechanism of the instrument has the capability of increasing the pressure of the sample sufficiently above the bubble point of the sample that any pressure reduction that occurs upon cooling will not decrease the pressure of the fluid sample below its bubble point.

FIG. 12 is a pictorial illustration including a block diagram schematic which illustrates a formation testing instrument constructed in accordance with the present invention being positioned at formation level within a well bore, with its sample probe being in communication with the formation for the purpose of conducting tests and acquiring one or more connate samples. As shown in FIG. 12, a section of a borehole 10 penetrating a portion of the earth formations 11, shown in vertical section. Disposed within the borehole 10 by means of a cable or wire line 12 is a sampling and measuring instrument 13. The sampling and measuring instrument is comprised of a hydraulic power system 14, a fluid sample storage section 15 and a sampling mechanism section 16. Sampling mechanism section 16 includes selectively extensible well engaging pad member 17, a selectively extensible fluid admitting sampling probe member 18 and bi-directional pumping member 19. The pumping member 19 could also be located above the sampling probe member 18 if desired.

In operation, sampling and measuring instrument 13 is positioned within borehole 10 by winding or unwinding cable 12 from hoist 20, around which cable 12 is spooled. Depth information from depth indicator 21 is coupled to signal processor 22 and recorder 23 when instrument 13 is disposed adjacent an earth formation of interest. Electrical control signals from control circuits 24 including a processor (not shown) are transmitted through electrical conductors contained within cable 12 to instrument 13.

These electrical control signals activate an operational hydraulic pump within the hydraulic power system 14 shown, which provides hydraulic power for instrument operation and which provides hydraulic power causing the well engaging pad member 17 and the fluid admitting member 18 to move laterally from instrument 13 into engagement with the earth formation 11 and the bi-directional pumping member 19. Fluid admitting member or sampling probe 18 can then be placed in fluid communication with the earth formation 11 by means of electrical controlled signals from control circuits 24 selectively activating solenoid valves within instrument 13 for the taking of a sample of any producible connate fluids contained in the earth formation of intent.

Figure 13:
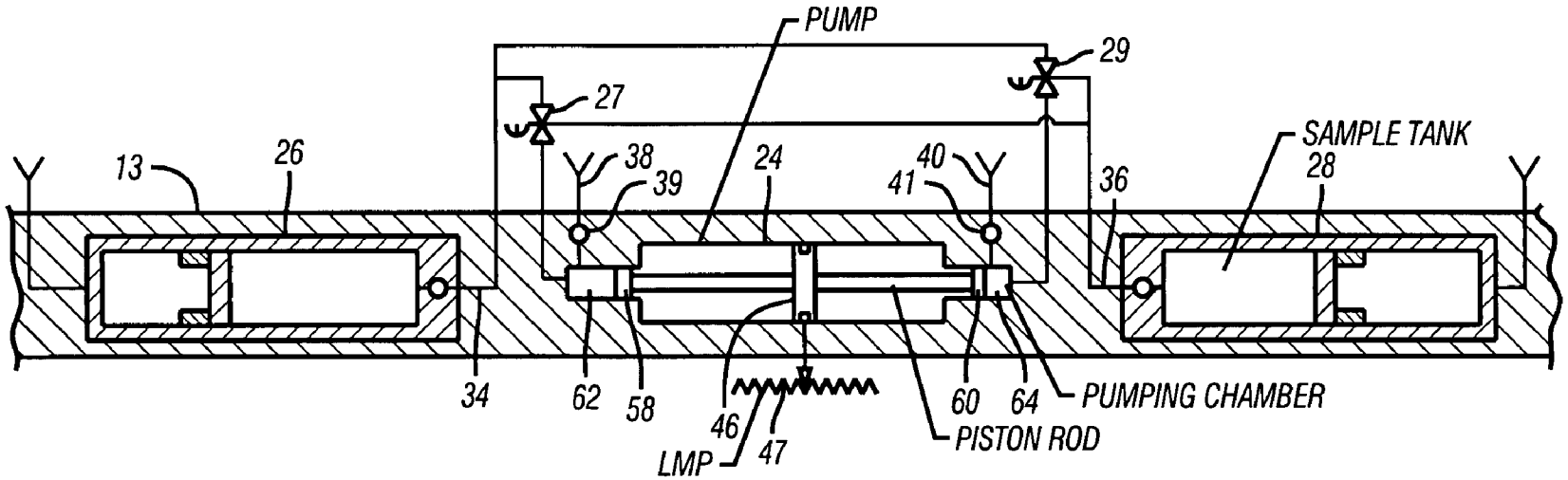
FIG. 13 is an illustration of a bi-directional formation fluid pump for pumping formation fluid into the well bore during pumping to free the sample of filtrate and pumping formation fluid into a sample tank after sample clean up.

FIG. 13 is an illustration of a bi-directional formation fluid pump for pumping formation fluid into the well bore during pumping to free the sample of filtrate and pumping formation fluid into a sample tank after sample clean up. FIG. 13 shows a portion of down hole formation multi-tester instrument which is constructed in accordance with the present invention and which illustrates schematically a piston pump and a pair of sample tanks within the instrument. FIGS. 12 and 13 are taken from Michaels et al. '775 and are described therein in detail.

As illustrated in the partial sectional and schematic view of FIG. 13, the formation testing instrument 13 of FIG. 12 is shown to incorporate therein a bi-directional piston pump mechanism shown generally at 24 which is illustrated schematically in FIG. 13. Within the instrument body 13 is also provided at least one and preferably a pair of sample tanks which are shown generally at 26 and 28 and which may be of identical construction if desired. The piston pump mechanism 24 defines a pair of opposed pumping chambers 62 and 64 which are disposed in fluid communication with the respective sample tanks via supply conduits 34 and 36. Discharge from the respective pump chambers to the supply conduit of a selected sample rank 26 or 28 is controlled by electrically energized three-way valves 27 and 29 or by any other suitable control valve arrangement enabling selective filling of the sample tanks. The respective pumping chambers are also shown to have the capability of fluid communication with the subsurface formation of interest via pump chamber supply passages 38 and 40 which are defined by the sample probe 18 of FIG. 12 and which are controlled by appropriate valving. The supply passages 38 and 40 may be provided with check valves 39 and 41 to permit overpressure of the fluid being pumped from the chambers 62 and 64 if desired. Position Sensor Resistor LMP 47 tracks the position and speed of pistons 58 and 60 from which pumping volume, over time, for a known piston cylinder size can be determined.

Figures 14, 15:
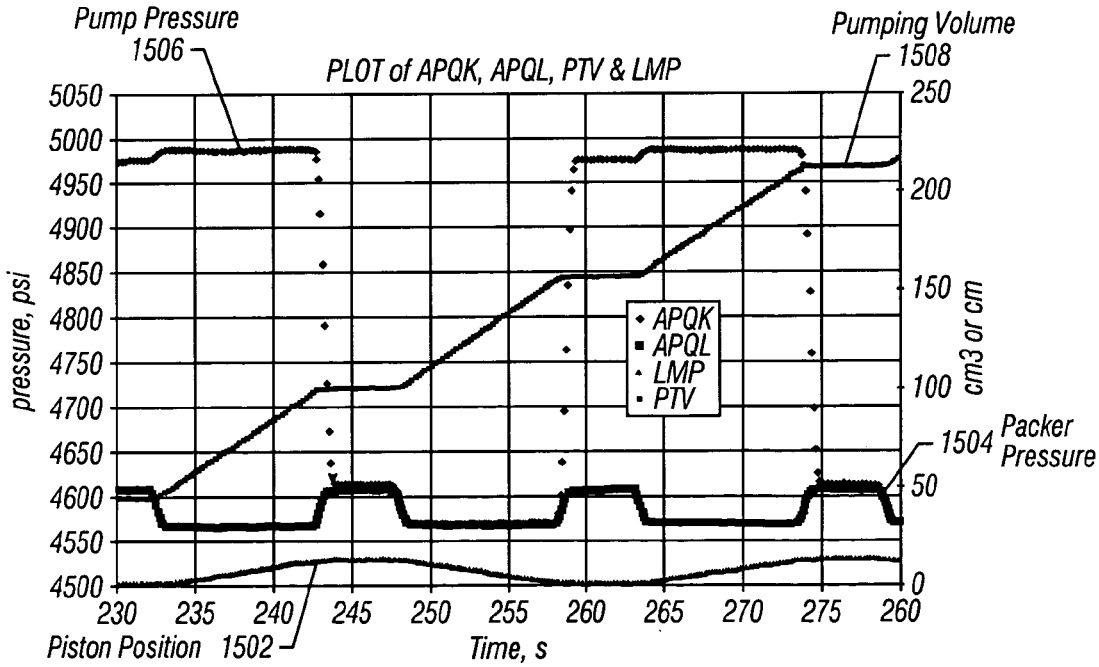
FIG. 14 of formation race analysis data values for three strokes of the formation fluid pump.
FIG. 15 is a plot of formation fluid pump pressure, packer pressure, linear volume displacement of the pumping piston and pumping volume for three strokes of the sampling pump in a first example of problem free pumping of formation fluid.

FIG. 14 of formation rate analysis data values for three strokes of the formation fluid pump. FIG. 15 is a plot of formation fluid pump pressure, packer pressure, linear volume displacement of the pumping piston and pumping volume for three strokes of the sampling pump in a first example of problem free pumping of formation fluid.

Figure 16:
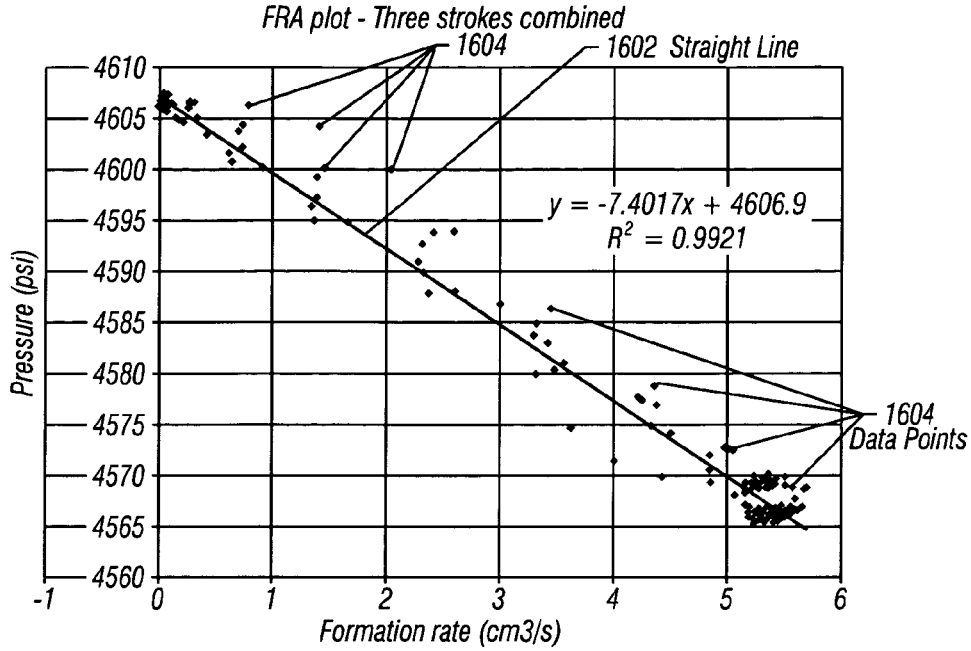
FIG. 16 is a plot of pump pressure versus formation flow rate for the three strokes illustrated in FIG. 14 and FIG. 15. Note that the correlation coefficient ($R^2$) in FIG. 16 and FIG. 14 are above 0.99 indicating that the pumping speed is well matched to the formation flow rate.
Figure 17:
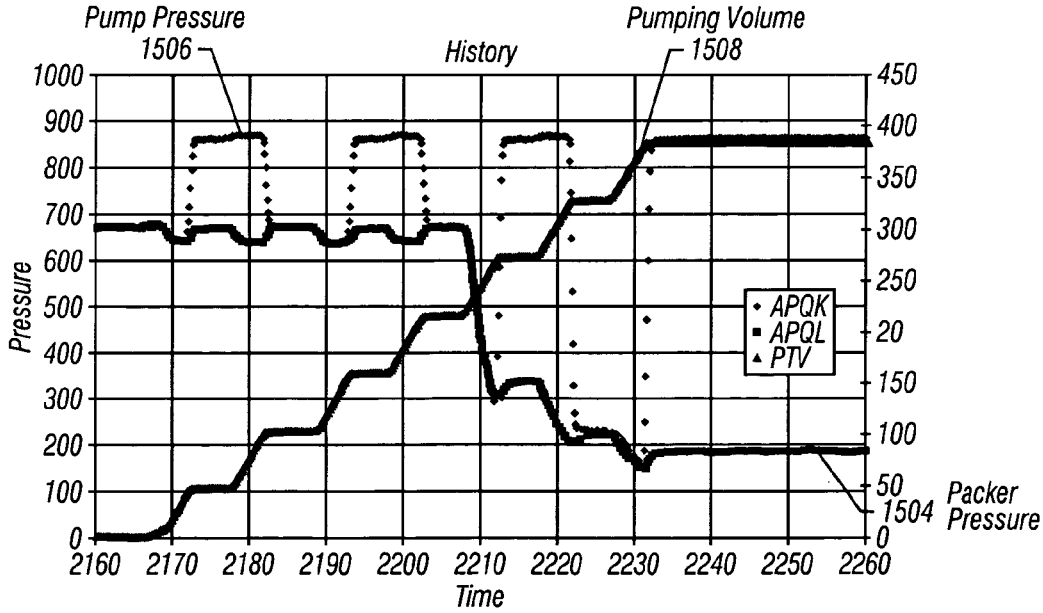
FIG. 17 is a second example of pumping history showing a plot of formation fluid pump pressure, packer pressure, linear volume displacement of the pumping piston and pumping volume for three strokes of the sampling pump in a second example of pumping of formation fluid where a problem is apparent.

FIG. 16 is a plot of pump pressure versus formation flow rate for the three strokes illustrated in FIG. 14 and FIG. 15. Note that the correlation coefficient ($R^2$)in FIG. 16 and FIG. 14 are above 0.99 indicating that the pumping speed is well matched to the formation flow rate. FIG. 17 is a second example of pumping history showing a plot of formation fluid pump pressure, packer pressure, linear volume displacement of the pumping piston and pumping volume for three strokes of the sampling pump in a second example of pumping of formation fluid where a problem is apparent.

Figure 18:
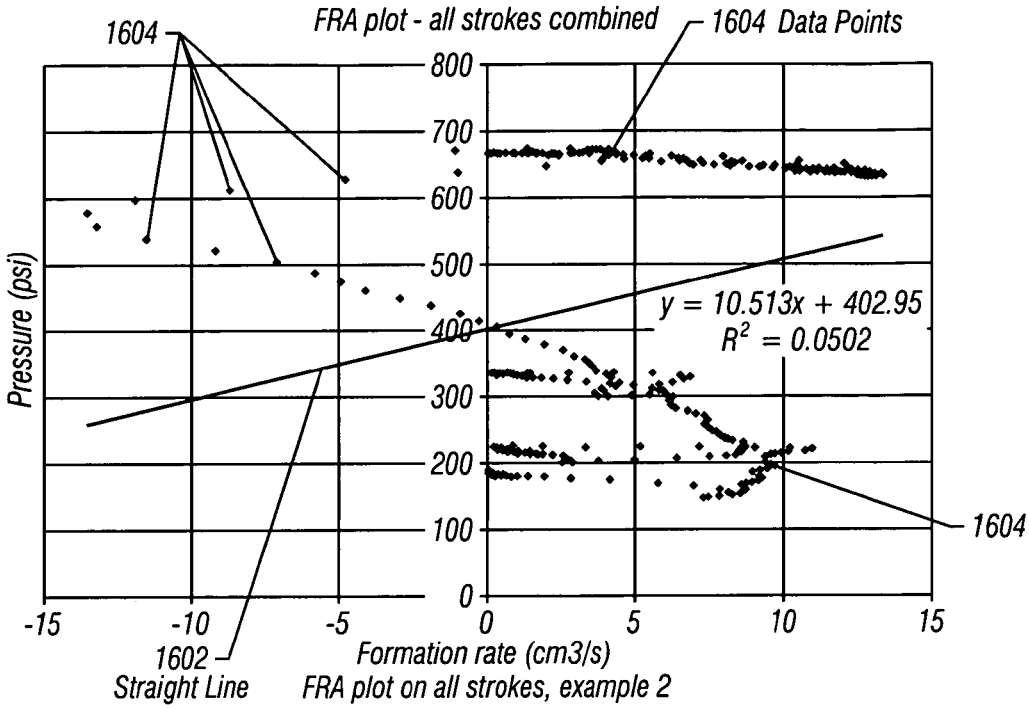
FIG. 18 is a plot for pressure versus formation rate for all pump strokes of the example of FIG. 17 showing a correlation coefficient ($R^2$) of only 0.052, indicative of a problem.
Figure 19:
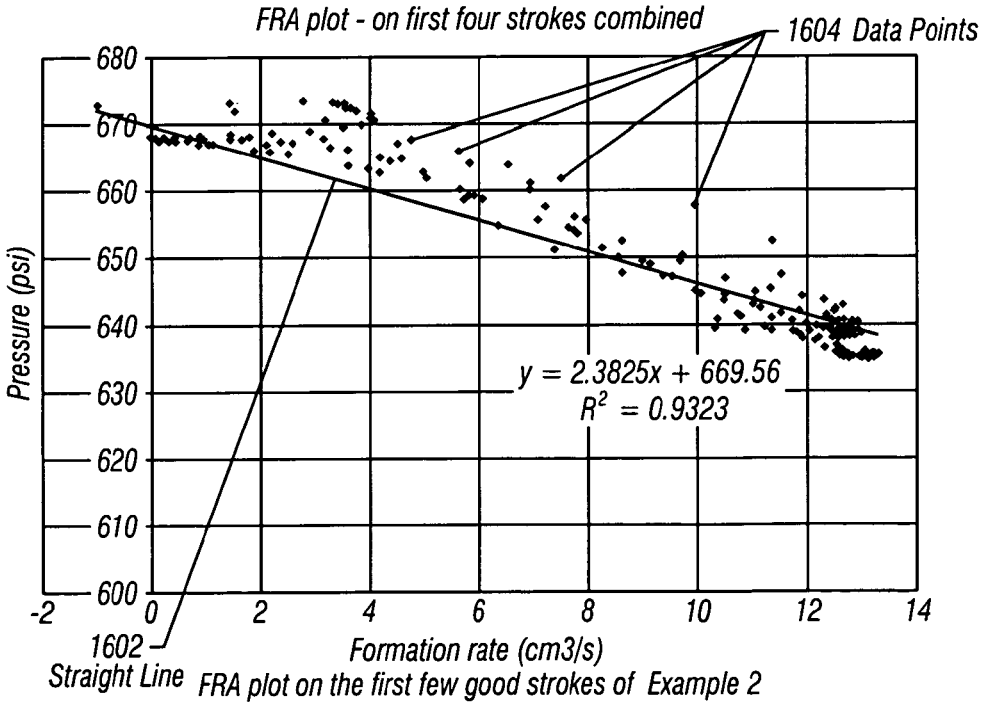
FIG. 19 is a plot for pressure versus formation rate for the first two pump strokes of the example of FIG. 17 showing a correlation coefficient ($R^2$) of 0.9323, indicative of a quality sample up to that point.

FIG. 18 is a plot for pressure versus formation rate for all pump strokes of the example of FIG. 17 showing a correlation coefficient ($R^2$) of only 0.052, indicative of a problem. FIG. 19 is a plot for pressure versus formation rate for the first two pump strokes of the example of FIG. 17 showing a correlation coefficient ($R^2$) of 0.9323, indicative of a quality sample up to that point.

The present invention runs FRA at the end of each pumping piston stroke on the suction side of the pump while the formation is building up to determine mobility, compressibility and correlation coefficient. The present invention provides a plot of mobility versus time as a deliverable to a sampling client as an indication of confidence of the integrity of the sample. The FRA plots pressure versus formation flow rate as shown in FIG. 16. The closer the plot is to a straight line, the higher the correlation coefficient. A correlation coefficient of above 0.8 indicates that the pumping rate is well matched to the formation's ability to produce formation fluid.

The plot of pressure as a function of time yields the formation pressure, P* as a result of solving the equation P(t)=P*−[reciprocal of mobility]×[formation flow rate]. The slope of this plot is negative and the y intercept is P* with P on the vertical axis. The reciprocal of the plot is the mobility. The degree to which the plot matches a straight line is the correlation coefficient. When the correlation coefficient falls below 0.8, a problem is indicated. The present invention will give an up arrow indication to the operator to increase pump speed when the formation is capable of delivering single-phase formation fluid at a faster pumping speed and a down arrow to decrease pump speed when the pumping speed exceeds the formation's ability to deliver single-phase formation fluid at the existing pumping speed.

The pump volume of chambers 62 and 64 are known and the position and rate of movement for the pistons 58 and 69 are known from LMP 47 so that FRA is performed on the bi-directional pump at the end of each pump stroke. As the draw down rate and pump volumes are known by the position of the piston and rate of change of position and the dimensions of the chamber 62 and 64, the draw down volume is also known or can be calculated.

$P_{saturation}-P^*=-(1/\text{mobility})(\text{formation rate})$. $P_{saturation}-P^*$ represents the window of tolerance of the sample before going into two-phase. Using FRA, formation fluid mobility is determined so that the formation flow rate is calculated and appropriate pumping rate $q_{dd}$ in equation 16 is calculated to match the formation flow rate as discussed below. The controller in the tool adjusts the pumping rate automatically by sending feedback signals to the hydraulic controller valving at the pump or sends a signal to the operator to adjust the pump rate to achieve optimal pumping rate to match the formation mobility.

During pumping when the bi-directional pump piston 58, 60 reaches the end of a pumping stroke, FRA is applied to the suction side of the pump. Before the pump piston 58, 60 moves, FRA uses formation build up at the end of each pump stroke to determine compressibility, mobility and a correlation coefficient for the formation fluid being pumped. Thus FRA during pumping provided by the present invention enables obtaining a correct draw down volume and draw down rate during single phase sampling using LMP data and pump dimensions. FRA data for mobility, compressibility, and FRA plots pressure gradients validate the sampling data and pressure test data. Thus, FRA while pumping ensures that the proper draw down rate is used to perform an accurate pressure test and obtain a single phase sample representative of the formation.

In accordance with the current embodiment of the present invention shown in FIGS. 12–19, the present invention provides an apparatus and method for monitoring the pumping formation fluids from a hydrocarbon bearing formation and providing quality control for the pumping through the use of the FRA techniques described above applied after each pump stroke. FRA is applied to the suction side of the pump while monitoring formation build up using FRA to calculate mobility, compressibility, correlation coefficient and P* versus time in accordance with the present invention. The present embodiment is a method that analyzes a wire line formation tester tool measurement data for formation pressure and formation fluid mobility by applying the FRA techniques described above at the end of each pump stroke of the bidirectional pump shown in FIG. 13. Formation testing tools typically perform pump out or pump through of formation fluid from the formation into the well bore in order to clean the mud filtrate prior to taking formation fluid samples. The pumping can last for hours in an attempt to obtain formation fluid free of filtrate (cleaned-up). Moreover, maintaining the pumping speed in the most efficient manner without encountering problems such as tool plugging, packer leakage, sanding or formation failure is a critical issue. The present invention applies FRA to pumping data using the known pump volume of the bi-directional pumping chamber 62 or 64.

Turning now to FIG. 13, FRA is applied to each pump stroke or to several combined strokes. FRA is applied to the pump stroke(s) of the bi-directional pump volumes 62 and 64 and pistons 58 and 60 to determine the formation mobility, fluid compressibility, and correlation coefficient. The FRA determined mobility indicates the formation's ability to produce hydrocarbons. It is imperative to efficient oil recovery operations to match the ability of the formation to produce with an appropriate pumping rate. Knowing the formation's ability to produce hydrocarbons enables matching this ability to an appropriate pump rate by either reducing the pump rate for low mobility or increasing the pump rate for high mobility. Matching the pump rate to the formation's ability to produce helps to achieve efficient pumping. Using the value for mobility determined using FRA while pumping, a maximum pump speed is calculated which keeps the flowing formation fluid pressure above the saturation or Bubble point pressure. Adopting the appropriate pumping speed as determined by FRA while pumping calculations increases the chances of collecting an unflashed, single-phase sample, which is truly representative of the formation.

FRA correlation coefficient determination provides an indication of pumping quality and problems. The pumping process may encounter myriad problems. Detecting a sign of such a problem early provides an important opportunity to avoid expensive if not catastrophic failures of the tool and enables a tool operator to change the pumping speed or even suspend or terminate the pumping process. In a exemplary embodiment the processor provided in the downhole tool informs the operator as to desired pumping speeds whether to increase or decrease pumping speed by displaying an up or down arrow to the operator at the surface and stoppage or automatically adjusts the pumping speed or stops pumping to address perceived problems during pumping.

The FRA correlation coefficient for a series of continuous pump strokes will be relatively high, i.e., above 0.8–0.9 when the pumping activities are free of problems, but the FRA correlation coefficient will deteriorate and become low again when problems are encountered in the pumping process. The FRA compressibility is used as an indicator for fluid type change during the pumping. With continuous monitoring of the formation fluid compressibility, a change in the type of fluid being pumped from the formation is quickly detected. Thus, when there is a significant difference between mud filtrate compressibility and the formation fluid compressibility, it is relatively easy to monitor formation clean-up as the compressibility changes from a value indicative of mud filtrate to a value indicative of formation fluid. Monitoring near infrared spectral optical density measurements are combined with FRA compressibility to determine formation sample clean up.

As shown in FIGS. 12–19, the present embodiment of the invention provides an apparatus and method for pumping quality control through formation rate analysis or FRA for each pump stroke over time. The pumping can last for hours, and maintaining the pumping process in most efficient manner free of problems such as tool plugging, packer leakage, or formation failure is a very important issue. The present invention applies FRA to pumping data when the pump volume is known. FRA is applied to each pump stroke or to several strokes combined. FRA on the pump stroke(s)

yields the formation mobility, fluid compressibility, and a correlation coefficient. The present invention uses FRA determined mobility to indicate the formation's ability to produce. The present embodiment of the invention uses the determination of the formation's ability to produce to select an appropriate pumping speed, thereby matching a lesser ability (e.g., an FRA determination of low mobility) to produce with a slower pumping speed by reducing the pump speed or increasing the pump speed when the formation has a greater ability to produce (if high mobility) enables improved efficiency by applying a complimentary pumping rate to match formation mobility. Using FRA pumping determinations for formation mobility, the present invention calculates and applies the maximum complimentary pumping rate, which will keep the pressure of the sample flowing through the pump and tool above the saturation or bubble point pressure and not take longer than necessary to obtain a sample by pumping too slow. The chances of collecting an un-flashed, representative sample are increased by applying the maximum complimentary pump speed calculated by the present invention using FRA at the end of each pumping cycle of the bi-directional pump.

Controlling the formation pumping speed according to the formation mobility optimizes the pumping process by matching the pump speed to the formation production rate. Matching the pumping speed to the formation ability to produce ensures that the formation sample being pumped into a sample tank stays in the single phase through out the process by not pumping faster than the formation can produce, thereby not lowering the pressure on the formation sample below the bubble point. The present invention also enables real time quality monitoring to indicate and detect any problems as they occur and indicate or automatically change pumping parameters to minimize the adverse effect. Formation clean up is monitored through the change in the FRA compressibility. Thus, the present invention enables optimization of the pumping process through integrated FRA during pumping. Thus the present invention provides an advantage in obtaining a representative formation sample.

The FRA technique for the pumping data is easily integrated into down hole sampling tools as an option to be turned on and turned off. Once the pumping optimization process is activated, the FRA mobility, compressibility, and the correlation coefficient are monitored constantly in real time. The present embodiment of the invention preferably performs the following steps.

The present invention utilizes FRA on a known pump volume for the bi-directional pump chambers 62 and 64 or a single direction pump chamber. The FRA technique can be applied to a single pump stroke or several pump strokes together and the mobility, compressibility, and the correlation coefficient will be calculated for the stroke or strokes. Using the FRA determined formation mobility the present invention calculates the optimal pumping speed to maintain the flowing pressure above the saturation pressure and notifies the tool engineer if a change in pumping parameters is needed to attain the optimal pressure or automatically adjusts the pumping speed to attain the optimal pressure where the pumping speed pressure is matched with the formation's ability to produce. The present invention continuously monitors the FRA mobility, compressibility, and the correlation coefficient during the pumping process to observe significant changes in the FRA mobility, compressibility, and the correlation coefficient to determine the formation's ability to produce or detect problems during pumping.

The FRA technique enables calculation of the formation rate for analysis. The following equation (16) is the basis for the analysis:

$$p(t)=p^*-(\mu/(kG_0r_i))(C_{sys}V_{sys}(dp(t)/dt)+q_{dd}). \quad (16)$$

The entire term, $C_{sys}V_{sys}(dp(t)/dt)+q_{dd}$, in the second parenthesis on the right side of the equation is the formation rate that is calculated by correcting the piston rate ($q_{dd}$) for tool storage effects. $C_{sys}$ is the compressibility of the fluid in the tool flow line and $V_{sys}$ is the volume of the flow line. $G_0$ is the geometric factor and $r_i$ is the probe radius.

The following terms are used in the FIGS. 15–29: APQK—Pressure curve for the pump gauge in psi; APQL—Pressure curve for the packer gauge in psi; LMP—Curve for linear volume displacement of the pumping piston or sample chamber piston to determine pumping volume. The LMP pumping piston position indicator potentiometer 47 is shown in FIG. 13. The LMP is useful in tracking both piston position and piston movement rate. The draw down volume (DDV) and pumping volume (PTV) are calculated from this curve using the pumping piston cross sectional area in cm; Pump (PTV–BB) volume curve is in $cm^3$. FRA is applicable to the pumping with small volume 56 cc pump when the pump volume is reported in the pumping volume (PTV) curve.

An example of the FRA applied to the small volume pump pumping data is given in FIG. 14. The data comprises p* 1410, mobility 1412, compressibility 1414 and correlation coefficient 1416. The pumping data were considered and analyzed stroke by stroke. The three pumping strokes 1402, 1404, 1406 data were then combined 1408. FIG. 15 shows the history plot of the pumping data used. As shown, three strokes of a small volume pump were used. The analysis results are summarized in FIG. 14. Note that the pump volume (PTV) curve was used instead of a draw down volume (DDV) for the draw down rate calculation.

FIG. 15 shows pump pressure 1506, packer pressure 1504, piston position 1502 and pumping volume 1508. In FIG. 15, a history of pumping data is used, three strokes of BB 56 cc sampling pump. In FIG. 16, FRA plot for the three strokes of FIG. 15 is combined. FIG. 16 is a pumping history showing the correlation coefficient of 0.9921 for the three strokes shown in FIG. 15.

As shown in FIG. 14, mobility and compressibility changes for each pump stroke, but are very close. Mobility increases only slightly. The FRA for three pumping strokes as combined generates a de facto average of sorts over three pumping strokes for compressibility and mobility. Turning now to FIG. 16, the ERA plot 1604 for the three pumping strokes combined, as shown in FIG. 16 illustrates a relatively good correlation to a straight line 1602 of 0.9921. The above example indicates the FRA can be successfully applied to pumping data when the Reservation Characterization Instrument™ (RCI) 56 cc (BB) pump is used and pumping volume (PTV) curves are turned on. FRA is applied to each stroke or can be applied to several strokes together in order to save computation time.

FRA is applied to a problem scenario for pumping strokes data set as shown in FIG. 17. As shown in FIGS. 17 and 18, the first few strokes occurred without a problem, but later the pressure shows a sign of a problem (e.g., tight formation, high viscosity, or tool plugging). The FRA plot of pressure versus formation flow rate for the entire set of strokes is given in FIG. 18, where there is little or no sign of correlation (correlation coefficient is very low, only 0.03). However, the FRA on the first few stokes, as shown in FIG. 19 is reasonably good with a correlation coefficient of 0.93 and mobility of 1040 md/cp, and a compressibility of 4.1 E-4 (1/psi). This example illustrates use of FRA while pumping as a quality indicator for pumping. The present invention applies FRA analysis to a few strokes of pumping and calculates or detects a change in the FRA plot or the correlation coefficient in order to detect any sign of pumping problems. The present embodiment of the invention determines any significant change, then requests or notifies the operator to or automatically operates to change the pump speed, checks for possible problems, or stop pumping due to a perceived condition requisite of pumping cessation.

The saturation pressure of the formation fluid or mixture of formation fluid and filtrate can be estimated through down hole expansion tests, or it can be estimated from a known data base data of correlated values. Once the formation mobility is obtained from FRA, the maximum pump rate that can still maintain flowing pressure above the saturation pressure is calculated using FRA. Also any significant change, e.g., one-half or one order of magnitude in FRA compressibility implies change in the fluid type flowing into the tool, which will be an indicator for formation clean up.

The present invention selects a portion of total draw down pump strokes and builds FRA data based on the calculated draw down rate. With the pumping data, an analysis interval is selected based on the number of pump strokes instead of draw down rate. The present invention uses a variable number of strokes through out the pumping, choosing small pump strokes at the beginning, e.g., two or three pump strokes, and progressively increasing the number of pump strokes up to a selectable fixed maximum strokes, e.g., 10 strokes, or in the present example, approximately 500 cc of pumped fluid.

Figure 20:
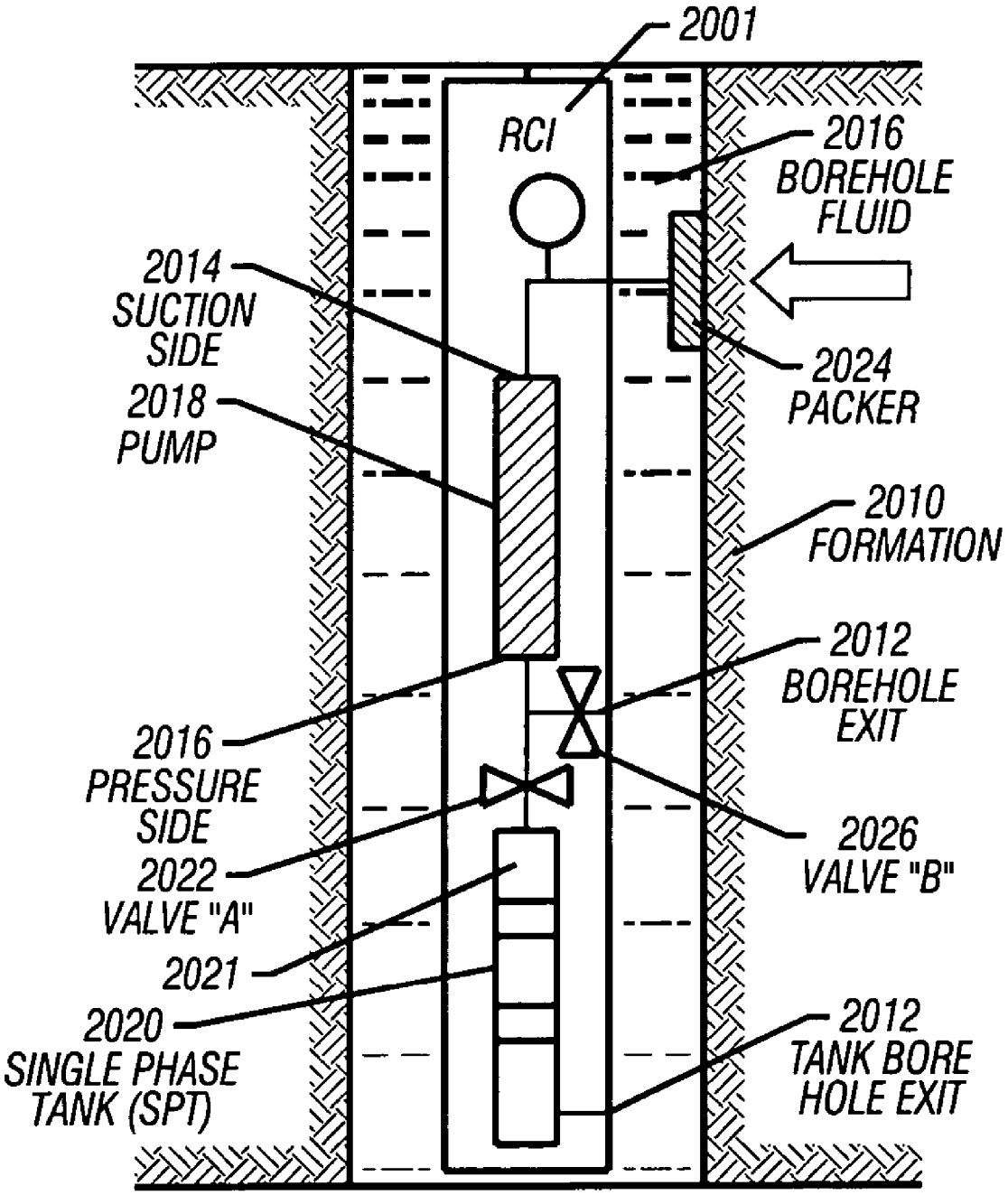
FIG. 20 is an illustration of a sampling tool where by a quality sample is pumped from a formation while measuring mobility/permeability versus time to ensure a single phase sample with low filtrate contamination, the sample having the same physical characteristics as it did when the sample existed in a formation.

Turning now to FIG. 20, an illustration of a sampling tool is presented. The present invention enables FRA during pumping of a sample from a formation. The FRA enables calculation of compressibility, permeability and mobility versus time. The monitoring of the permeability versus time enables an estimate or determination of the degree of filtrate contamination in the sample. As the compressibility of formation fluid is greater than the compressibility of filtrate, thus the compressibility steadily declines and levels off asymptotically to a steady state value as the formation sample is cleaned up and rid of filtrate during pumping of the formation fluid sample form the formation.

As shown in FIG. 20, pump 2018 pumps formation fluid from formation 2010. The formation fluid from the formation 2010 is directed either to the borehole exit 2012 during sample cleanup or to single phase sample Lank 2020 and captured as sample 2021 once it is determined that the formation sample is cleaned up. The present invention enables monitoring of compressibility, permeability and mobility versus time in real time to enable quality control of the sample so that the sample remains in the same state as it existed in the formation. Borehole fluid 2016 surrounds the tool 2001. Packer 2024 contacts formation 2010. Formation fluid enters the tool 2001 on suction side 2014 of pump 2018 and exits pressure side 2016. Valve A 2022 allows fluid to enter single phase tank 2020 sample vessel or chamber 2021. Valve B 2026 allows fluid to exit 2012 to the borehole. The bottom chamber 2028 of single phase tank 2020 is open to the borehole pressure.

The suction side 2014 of the pump 2018 drops below formation pressure to enable flow of the formation fluid from the formation into the pump 2018. The amount of pressure drop below formation pressure on the suction side of the pump is set by the present invention. The amount of the pressure drop is set so that the sample pressure does not go below the bubble point pressure. The amount of the pressure drop on the suction side is also set so that the pressure does not drop below the pressure at which asphaltenes do not precipitate out of the sample, thereby ensuring that the sample stays in the liquid form in which it existed in the formation. Thus, a first pressure drop is set so that the pressure drop during pumping does not go below the bubble point pressure and gas bubbles are formed. A second pressure drop is set so that the pressure drop during pumping does not go below the pressure at which solids such as asphaltenes precipitate from the formation fluid. Thus, the provision of the first and second pressure drops ensures delivery of a formation fluid sample without a change in state of additional gas or solid. The first and second pressure drops values are determined by the bubble point pressure and solids precipitation pressures provide by modeling or prior data analysis for the formation. The monitoring of the sample filtrate cleanup ensures that the formation fluid sample does not contain filtrate, or contains a minimum amount of filtrate so that the composition formation fluid sample is representative of the composition of the formation fluid as it exists in the formation.

In another embodiment of the present invention, the method of the present invention is implemented as a set computer executable of instructions on a computer readable medium, comprising ROM, RAM, CD ROM, Flash or any other computer readable medium, now known or unknown that when executed cause a computer to implement the method of the present invention.

While the foregoing disclosure is directed to the exemplary embodiments of the invention various modifications will be apparent to those skilled in the art. It is intended that all variations within the scope of the appended claims be embraced by the foregoing disclosure. Examples of the more important features of the invention have been summarized rather broadly in order that the detailed description thereof that follows may be better understood, and in order that the contributions to the art may be appreciated. There are, of course, additional features of the invention that will be described hereinafter and which will form the subject of the claims appended hereto.

The invention claimed is:

1. A method for estimating a flow rate of a fluid from a formation, comprising:

pumping to remove the fluid from the formation;

measuring fluid pressure during pumping;

tracking a volume pumped during pumping;

estimating a fluid property comprising at least one of the set consisting of permeability, mobility and compressibility for the fluid from the flow rate;

optimizing a fluid pumping rate based the property to acquire the fluid substantially in a single-phase; and estimating the flow rate of the fluid from the measured pressure and volume.

2. The method of claim 1, wherein tracking volume comprises tracking a position of a pumping piston.

3. The method of claim 1, wherein the measuring the fluid pressure further comprises measuring pressure in a flow line for the fluid.

4. The method of claim 1 further comprising:

detecting a pumping problem if the property is outside a predetermined limit.

5. The method of claim 1, further comprising estimating a quality of the fluid from the property over time.

6. The method of claim 1, further comprising:

determining a correlation coefficient for estimates of the property; and detecting a pumping problem based on the correlation coefficient.

7. A method for estimating a flow rate of a fluid from a formation, comprising:

pumping to remove the fluid from the formation;

measuring fluid pressure during pumping;

tracking a volume pumped during pumping;

estimating a fluid property comprising at least one of the set consisting of permeability, mobility and compressibility for the fluid from the flow rate;

estimating the flow rate of the fluid from the measured pressure and volume;

monitoring the fluid property versus time to determine formation cleanup.

8. A method for estimating a flow rate of a fluid from a formation, comprising:

pumping to remove the fluid from the formation;

measuring fluid pressure during pumping;

tracking a volume pumped during pumping;

estimating the flow rate of the fluid from the measured pressure and volume; and monitoring the flow rate versus time to determine whether a formation fluid sample is in a single phase state.

9. A method for determining success of a pumping operation comprising:

estimating flow rate and pressure for a fluid pumped from a formation; and estimating a correlation between the flow rate and pressure; and estimating the success of the pumping operation based on the correlation, wherein success of the pumping operation further comprises a limited pressure drop in a sample acquired.

10. The method of claim 9 further comprising:

maximizing a pumping rate based on the correlation, to acquire the fluid in a single-phase.

11. An apparatus for retrieving fluid comprising:

a pump whose volume can be tracked that retrieves the fluid from a formation;

a pressure gauge that measures pressure of the fluid; and a processor programmed to track success of retrieving the fluid from volume and pressure, wherein the processor is programmed to estimate a fluid property selected from a group consisting of permeability, mobility and compressibility, wherein the pump removes the fluid at a rate based on the property to acquire the fluid substantially in a single-phase.

12. The apparatus of claim 11, where processor changes speed of pumping to optimize retrieval.

13. The apparatus of claim 11, further comprising:

a tank for holding the fluid.

14. The apparatus of claim 11 wherein the processor is programmed to provide an indicator to maximize the pumping rate based on the property, to acquire the fluid in a single-phase.

15. The apparatus of claim 11, wherein the pump removes the fluid from the formation and pumps the fluid into a sample chamber through a flow line.

16. The apparatus of claim 11, wherein the pressure gauge measures fluid pressure in the flow line.

17. The apparatus of claim 11, wherein the processor detects a pumping problem if the property is outside a predetermined limit.

18. An apparatus for retrieving fluid comprising:

a pump whose volume can be tracked that retrieves the fluid from a formation;

a pressure gauge that measures pressure of the fluid; and a processor programmed to track success of retrieving the fluid from volume and pressure, wherein the processor is programmed to estimate a fluid property selected from a group consisting of permeability, mobility and compressibility, wherein the processor is further programmed to one of: (i) estimate a quality of the fluid from the property measured over time, (ii) estimate a correlation coefficient for estimates of the property and detect a pumping problem based on the correlation coefficient, (iii) monitor the property versus time to determine formation cleanup, and (iv) monitor the property versus time and estimate whether the fluid sample is in a single phase state.

19. A system for estimating a property of a fluid, comprising:

a down hole tool;

a pump in the downhole tool that removes the fluid from a formation, wherein the pump removes the fluid at a rate based on the property to acquire the fluid substantially in a single-phase;

a pump position indicator;

a pressure gauge that measures fluid pressure corresponding to a pump piston position indicated by the pump position indicator; and a processor that estimates the property of the fluid from the measured pressure and pump position.

20. The downhole tool of claim 19, wherein the property is selected from a group consisting of permeability, mobility and compressibility.

21. The downhole tool of claim 19 wherein the processor provides an indicator to maximize the pumping rate based on the property, to acquire the fluid in a single-phase.

22. The downhole tool of claim 19, wherein the pump removes the fluid from the formation and pumps the fluid into a sample chamber through a flow line.

23. The downhole tool of claim 22, wherein the pressure gauge measures fluid pressure in the flow line.

24. The downhole tool of claim 19, wherein the processor detects a pumping problem if the property is outside a predetermined limit.

25. The downhole tool of claim 19, wherein the processor is programmed to estimate a quality of the fluid from the property measured over time.

26. The downhole tool of claim 19, wherein the processor is programmed to estimate a correlation coefficient for estimates of the property and detect a pumping problem based on the correlation coefficient.

27. The downhole tool of claim 19, wherein the processor is programmed to monitor the property versus time to estimate formation cleanup.

28. The downhole tool of claim 19, wherein the processor monitors the property versus time to estimate whether the fluid is in a single phase state.

* * * * *